US008882514B2

(12) United States Patent
Enge et al.

(10) Patent No.: US 8,882,514 B2
(45) Date of Patent: Nov. 11, 2014

(54) DATACOMMUNICATIONS MODULES, CABLE-CONNECTOR ASSEMBLIES AND COMPONENTS THEREFOR

(75) Inventors: Ryan Enge, Carrollton, TX (US); Theodore Alan Conorich, Lake Hiawatha, NJ (US); Patrick Fariello, Murphy, TX (US); Richard L. Case, Omaha, NE (US); Timothy W. Anderson, Oamaha, NE (US); Troy Long, Omaha, NE (US); Julian Robert Pharney, Indianapolis, IN (US); G. Mabud Choudhury, Warren, NJ (US); Richard Mei, Parker, TX (US); Yinglin Yang, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 274 days.

(21) Appl. No.: 13/167,161

(22) Filed: Jun. 23, 2011

(65) Prior Publication Data

US 2012/0040539 A1 Feb. 16, 2012

Related U.S. Application Data

(60) Provisional application No. 61/358,063, filed on Jun. 24, 2010.

(51) Int. Cl.
*H01R 12/00* (2006.01)
*H01R 9/03* (2006.01)

(52) U.S. Cl.
CPC ..... *H01R 9/032* (2013.01)
USPC ..... 439/76.1; 439/676

(58) Field of Classification Search
USPC ..... 439/76.1, 676
See application file for complete search history.

(56) References Cited

U.S. PATENT DOCUMENTS 2,609,417 A * 9/1952 Cox et al. ..... 174/69
3,271,508 A * 9/1966 Burr ..... 174/113 R (Continued)

FOREIGN PATENT DOCUMENTS

EP 1 727 020 A2 11/2006
EP 2 034 565 A2 3/2009

(Continued)

OTHER PUBLICATIONS

Invitation to Pay Additional Fees and Partial International Search for PCT/US2011/041554 dated Sep. 29, 2011.

(Continued)

*Primary Examiner* — Truc Nguyen
(74) *Attorney, Agent, or Firm* — Muncy, Geissler, Olds & Lowe, P.C.

(57) ABSTRACT

A combination includes: (a) a communications module including: a housing; a printed wiring board mounted within the housing; a plurality of RJ-45 jacks mounted on the printed wiring board and accessible from one side of the housing; and a single module connector mounted to the printed wiring board and electrically connected to the RJ-45 jacks, connector being accessible from a second side of the housing; and (b) a cable-connector assembly including: a cable comprising a plurality of subunits, each of the subunits comprising a jacket and a plurality of twisted pairs of conductors positioned within the jacket; and a single cable connector mounted to the printed circuit board and electrically connected to the conductors of the cable subunits. The module connector is attached to the cable connector.

6 Claims, 30 Drawing Sheets

(56) References Cited

U.S. PATENT DOCUMENTS

| | | | | |
|---|---|---|---|---|
| 3,350,647 | A * | 10/1967 | Gabriel et al. | 725/144 |
| 4,707,043 | A | 11/1987 | Reed | |
| 4,767,338 | A | 8/1988 | Dennis et al. | |
| 5,340,333 | A | 8/1994 | Schroth | |
| 5,658,166 | A | 8/1997 | Freeman et al. | |
| 5,690,511 | A | 11/1997 | Melito | |
| 5,944,535 | A | 8/1999 | Bullivant | |
| 6,080,018 | A * | 6/2000 | Ferrill et al. | 439/607.47 |
| 6,086,415 | A | 7/2000 | Sanchez et al. | |
| 6,238,246 | B1 * | 5/2001 | Ferrill et al. | 439/607.47 |
| 6,290,532 | B1 * | 9/2001 | Vermeersch et al. | 439/460 |
| 6,302,742 | B1 | 10/2001 | Berst | |
| 6,358,093 | B1 * | 3/2002 | Phommachanh et al. | 439/620.23 |
| 6,482,039 | B2 * | 11/2002 | Phommachanh et al. | 439/620.22 |
| 6,537,106 | B1 | 3/2003 | Follingstad | |
| 6,585,528 | B1 * | 7/2003 | Lin et al. | 439/76.1 |
| 7,140,885 | B2 * | 11/2006 | Kitamura | 439/76.1 |
| 7,404,736 | B2 | 7/2008 | Herbst et al. | |
| 7,699,646 | B2 * | 4/2010 | Zhu et al. | 439/493 |
| 7,909,643 | B2 | 3/2011 | Pepe et al. | |
| 7,914,324 | B2 | 3/2011 | Pepe et al. | |
| 8,075,348 | B2 | 12/2011 | Mei et al. | |
| 8,096,833 | B2 | 1/2012 | Tobey | |
| 8,151,457 | B2 * | 4/2012 | Hammond et al. | 29/884 |
| 8,235,731 | B1 | 8/2012 | Poulsen et al. | |
| 8,398,441 | B2 | 3/2013 | Mei et al. | |
| 2005/0282432 | A1 | 12/2005 | Murr et al. | |
| 2006/0025010 | A1 | 2/2006 | Spitaels et al. | |
| 2006/0046569 | A1 | 3/2006 | Kondou et al. | |
| 2007/0044996 | A1 * | 3/2007 | Clark | 174/113 R |
| 2007/0270044 | A1 | 11/2007 | Bellopolsky et al. | |
| 2008/0132113 | A1 | 6/2008 | Male | |
| 2009/0068881 | A1 | 3/2009 | Patchett | |
| 2013/0164980 | A1 | 6/2013 | Mei et al. | |

FOREIGN PATENT DOCUMENTS

| | | | |
|---|---|---|---|
| EP | 2 034 565 | A3 | 3/2009 |
| FR | 2 768 862 | | 3/1999 |
| FR | 2768862 | A1 | 3/1999 |
| JP | 2009 277592 | A | 11/2009 |
| WO | WO 2010/123958 | A1 | 10/2010 |

OTHER PUBLICATIONS

Communication pursuant to Article 94(3) EPC for European Patent Application No. EP10715634.1 mailed Jul 31, 2012.

International Search Report and the Written Opinion for PCT/US2011/041554 mailed on Nov. 21, 2011.

Written Opinion of the International Preliminary Examining Authority for PCT/US2010/031830, mailed on Jun. 1, 2011.

* cited by examiner

DATACOMMUNICATIONS MODULES, CABLE-CONNECTOR ASSEMBLIES AND COMPONENTS THEREFOR

RELATED APPLICATION

This application claims priority from U.S. Provisional Patent Application No. 61/358,063, filed Jun. 24, 2010, the disclosure of which is hereby incorporated herein in its entirety.

FIELD OF THE INVENTION

The present invention relates generally to communications equipment, and more particularly to connectors and cables for communications.

BACKGROUND

A network patching system is typically used to interconnect the various communication lines within a closet, computer room or data center. In a conventional network patching system, the communication lines are terminated within a closet or cabinet in an organized manner via one or more patch panels mounted on a rack or frame. Multiple ports are included in the patch panel, typically in some type of organized array. Each of the different ports is connected with a communications line. In small patching systems, all communications lines may terminate on the patch panels of the same rack or cabinet. In larger patching systems, multiple racks or cabinets may be used, wherein different communications lines terminate on different racks or cabinets. Interconnections between the various communications lines are made by connecting patch cords to the ports. By selectively connecting the various communications lines with patch cords, any combination of communications lines can be interconnected.

A patch panel typically includes connectors (such as RJ-45 jacks) on its front surface that receive mating connectors (such as RJ-45 plugs) for interconnection with other equipment. In most patch panels, a cable with a plurality of individual conductors is routed to the rear of the patch panel. The connection between the cable and the connectors of the patch panel is typically made through punch-down connectors or insulation displacement contacts (IDCs). Making these connections can be rather time-consuming, as can making changes to the connections subsequently. Moreover, as performance requirements become more stringent, it may be difficult for some types of connections to meet higher (e.g., Category 6A) performance requirements.

In view of the foregoing, it may be desirable to provide other configurations for patch panels and the like that simplifies interconnections and/or enhances performance.

SUMMARY

As a first aspect, embodiments of the present invention are directed to a cable-connector assembly. The cable-connector assembly comprises: a cable comprising a plurality of subunits, each of the subunits comprising a jacket and a plurality of twisted pairs of conductors positioned within the jacket; a printed circuit board, the conductors of the cable subunits being attached to the printed circuit board; and a single connector mounted to the printed circuit board and electrically connected to the conductors of the cable subunits.

As a second aspect, embodiments of the present invention are directed to a cable-connector assembly, comprising: a cable comprising a plurality of subunits, each of the subunits comprising a jacket and a plurality of twisted pairs of conductors positioned within the jacket, the cable subunits arranged in side-by-side relationship; and a single connector electrically connected to the conductors of the cable subunits.

As a third aspect, embodiments of the present invention are directed to a combination, comprising: (a) a communications module comprising: a housing; a printed wiring board mounted within the housing; a plurality of RJ-45 jacks mounted on the printed wiring board and accessible from one side of the housing; and a single module connector mounted to the printed wiring board and electrically connected to the RJ-45 jacks, connector being accessible from a second side of the housing; and (b) a cable-connector assembly, comprising: a cable comprising a plurality of subunits, each of the subunits comprising a jacket and a plurality of twisted pairs of conductors positioned within the jacket; and a single cable connector mounted to the printed circuit board and electrically connected to the conductors of the cable subunits. The module connector is attached to the cable connector.

As a fourth aspect, embodiments of the present invention are directed to a cable-connector assembly, comprising: a cable comprising a plurality of subunits, each of the subunits comprising a plurality of twisted pairs of conductors; a connector attached to one end of the cable, the connector including a plurality of elongate contacts, each of the contacts corresponding to a respective conductors of the cable, each of the contacts having a contact end and an open loop at an opposite end; and a plurality of transition elements connecting each of the conductors with its respective contact, each of the transition elements including a first end adapted to receive and connect to with a conductor and a second end adapted to receive and connect to the open loop of a contact.

As a fifth aspect, embodiments of the present invention are directed to a datacommunications cable assembly, comprising: a cable comprising a plurality of subunits, each of the subunits comprising a plurality of twisted pairs of conductors; and a cable subunit adapter. The cable subunit adapter comprises: four cable receiving channels, each of the channels including a longitudinal axis that is offset from the longitudinal axes of its neighboring receiving channels in both X and Y directions, each of the receiving channels receiving a respective cable subunit of the cable; and guides positioned below each receiving channel, the guides configured to separate each of the twisted pairs of the cable subunit from the other twisted pairs of the cable subunit.

As a sixth aspect, embodiments of the present invention are directed to a datacommunications cable assembly, comprising: a cable comprising a plurality of subunits, each of the subunits comprising a plurality of twisted pairs of conductors; and a printed circuit board having at least one edge, the edge including a plurality of open-ended recesses, each of the recesses connected to a conductive trace. Each of the conductors of the cable is received in one of the open-ended recesses.

As a seventh aspect, embodiments of the present invention are directed to a combination comprising: (a) a datacommunications module, comprising: a plurality of datacommunications jacks; a vertically disposed printed circuit board; the jacks mounted on a first surface of the printed circuit board; a plurality of elongate contacts mounted to a second, opposed surface of the printed circuit board, the contacts extending being connected with the jacks and extending away from the second surface; and (b) a cable-connector assembly comprising: a horizontally disposed printed circuit board; a connector mounted to the horizontally mounted printed circuit board and connected to the elongate contacts; and a cable comprising a plurality of subunits, each of the subunits comprising a plurality of twisted pairs of conductors, the twisting pairs of conductors being connected to the horizontal printed circuit board.

As an eighth aspect, embodiments of the present invention are directed to a cable-connector assembly, comprising: a cable comprising a plurality of subunits, each of the subunits comprising a plurality of twisted pairs of conductors; a printed circuit board with electrical traces residing thereon, the printed circuit board having first and second opposed surfaces; and a connector mounted on the printed circuit board and connected with the electrical traces. Some of the subunits are connected with respective electrical traces at mounting locations on the first surface of the printed circuit board, and others of the subunits are connected with respective electrical traces at mounting locations on the second side of the printed circuit board.

DESCRIPTION OF EMBODIMENTS OF THE INVENTION

Figure 1:
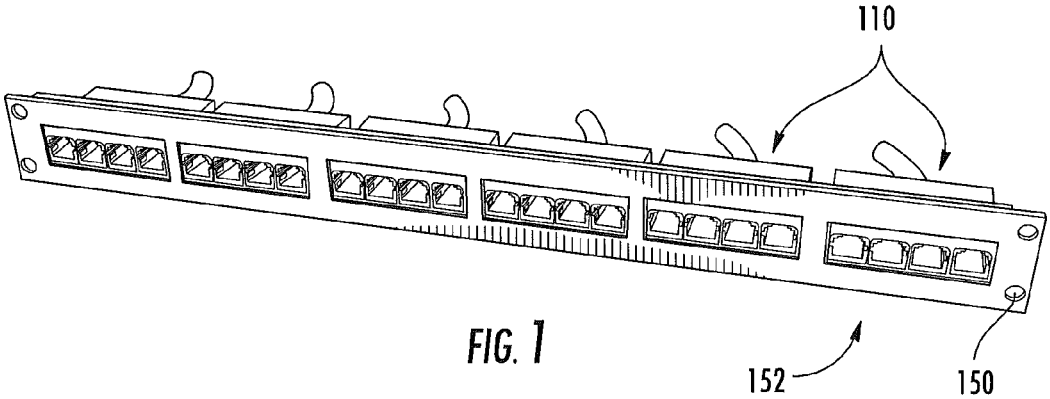
FIG. 1 is a schematic perspective view of a cable-connector assembly according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" or "above" the other elements or features. Thus, the exemplary term "under" can encompass both an orientation of over and under. The device may be otherwise oriented (rotated 90 degrees or at other orientations) and the spatially relative descriptors used herein interpreted accordingly. As used herein, "vertical" has the conventional meaning, i.e., upright; or at a right angle to the horizon.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "mounted" and the like can mean either direct or indirect attachment or contact between elements, unless stated otherwise.

Also, as used herein the term "connector" is intended to encompass telecommunications connectors and devices employed to facilitate the interconnection of telecommunications cords and cables for the transmission of signals therebetween. A connector may include a termination device at the end of a cord or cable, an adapter that facilitates the interconnection of two termination devices, a jack, plug, or the like typically employed with copper cables and cords, or other devices that provide a location or site for the interconnection of cables and cords.

Figure 2:
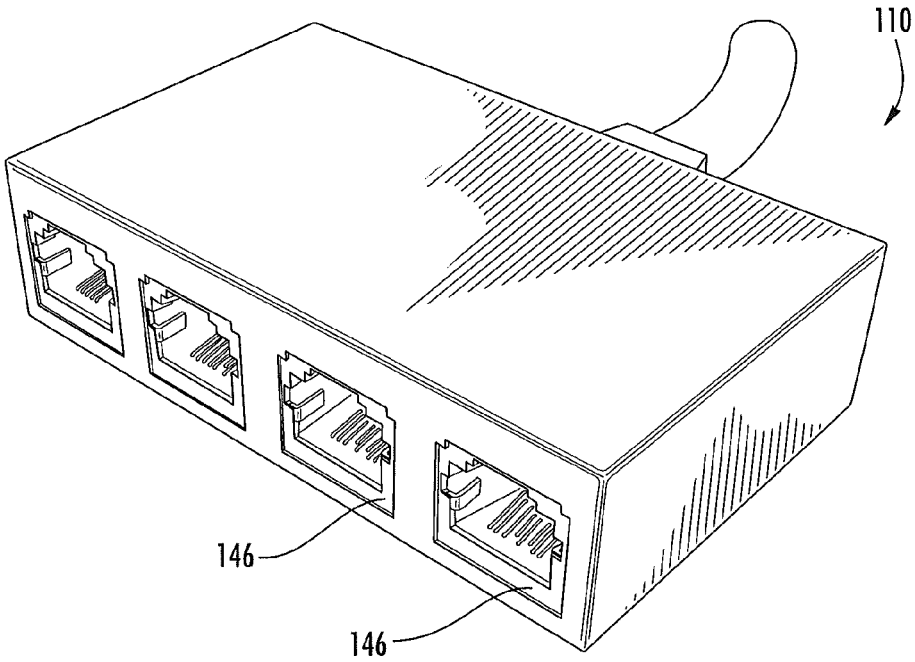
FIG. 2 is an enlarged perspective view of a module of the cable-connector assembly of FIG. 1.
Figure 3:
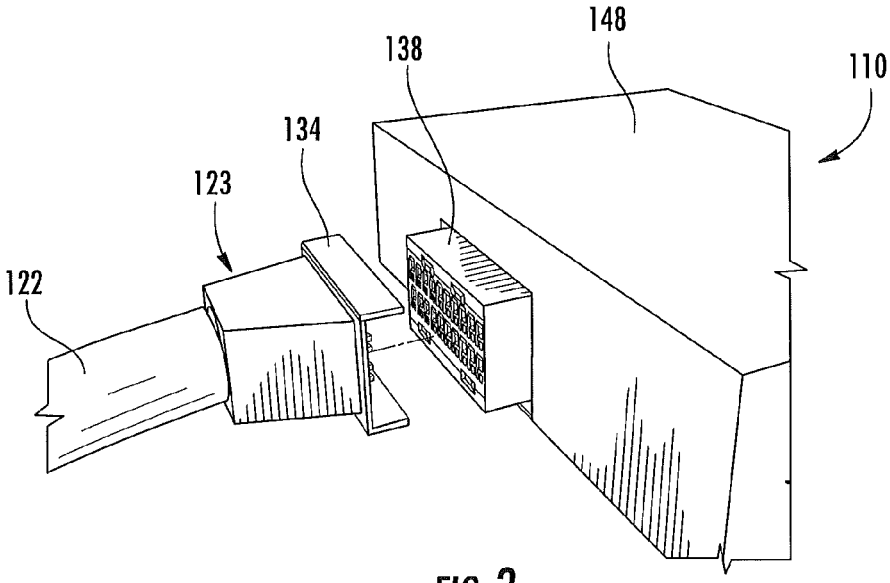
FIG. 3 is a rear perspective view of the module of FIG. 2 with a cable being connected thereto.
Figure 3A:
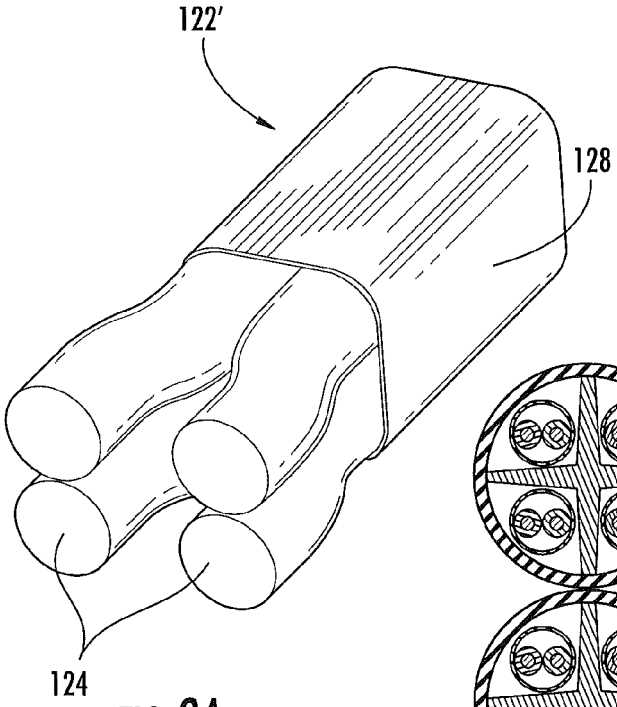
FIG. 3A is a perspective section view of the cable shown in FIG. 3.
Figure 3B:
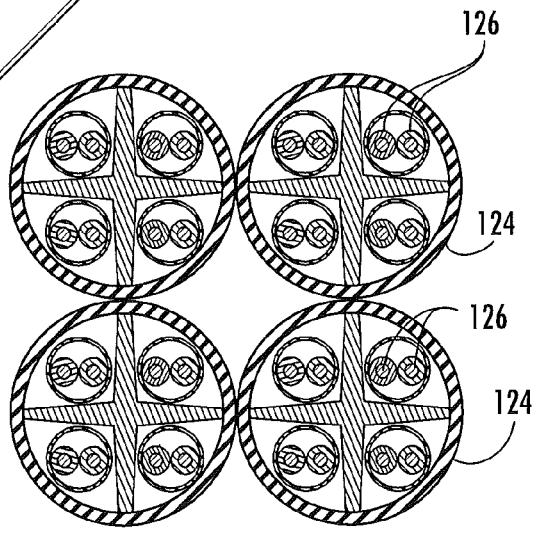
FIG. 3B is an enlarged cross-section of the cable shown in FIG. 3A.
Figure 29:
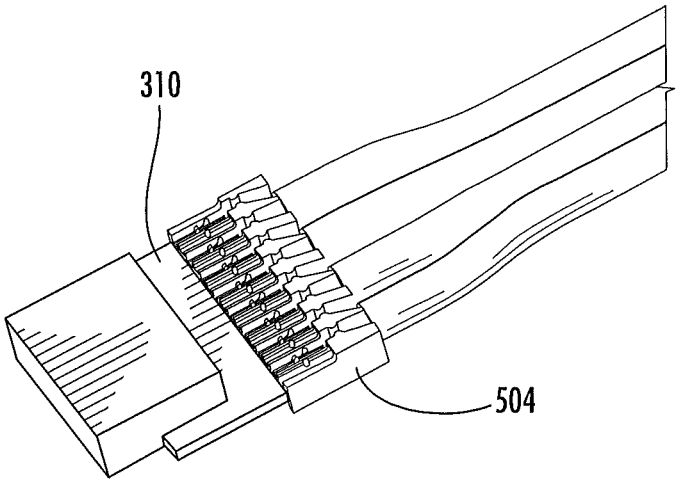
FIG. 29 is an assembled perspective view of the components of FIG. 28 with the cable attached.

Referring now to the figures, a patch panel 152 that includes six modules 110 mounted to a bezel 150 is shown in FIG. 1. An exemplary module 110 with its four RJ-45 jacks 146 is shown in FIG. 2. FIG. 3 is a reverse angle view of FIG. 2 illustrating that a cable 122 connected to a termination module 123 interconnects with a connector 138 mounted in the housing 148 of the module 110. More specifically, the termination module 123 includes a connector 134 that mates with the connector 138. The connectors 134, 138 shown in FIG. 3 are 2-pair×9 connectors (available, for example, from Foxconn Technology Group, Tucheng City, Taipei, Taiwan), although connectors of other configurations may also be employed. FIG. 3A is an enlarged view of the cable 122 illustrating that the cable 122 includes four subunits 124, each of which has four twisted pairs of conductors 126 (FIG. 3B). The subunits 124 may be covered with a jacket 128 as shown in FIG. 3A, and may take a configuration with a "square" profile as shown in FIG. 3B; in other embodiments, the cable 122 may take a flatter "ribbon" profile, such as is shown in FIG. 29, wherein the subunits 124 are bonded together or connected with bands of material that extend between subunits 124.

The modules 110, 123 may be employed in particularly high performance environments, such as Category 6A environments. Exemplary uses and environments for the module 110, termination module 123, and cable 122 are discussed in U.S. Provisional Patent Application No. 61/171,899, filed Apr. 23, 2009, and U.S. patent application Ser. No. 12/763,410, filed Apr. 20, 2010, the disclosure of each of which is hereby incorporated herein in its entirety. The connectors 134, 138 and associated components are selected to meet the desired level of performance. Different configurations of the module 110 and its components are discussed below.

Figure 4:
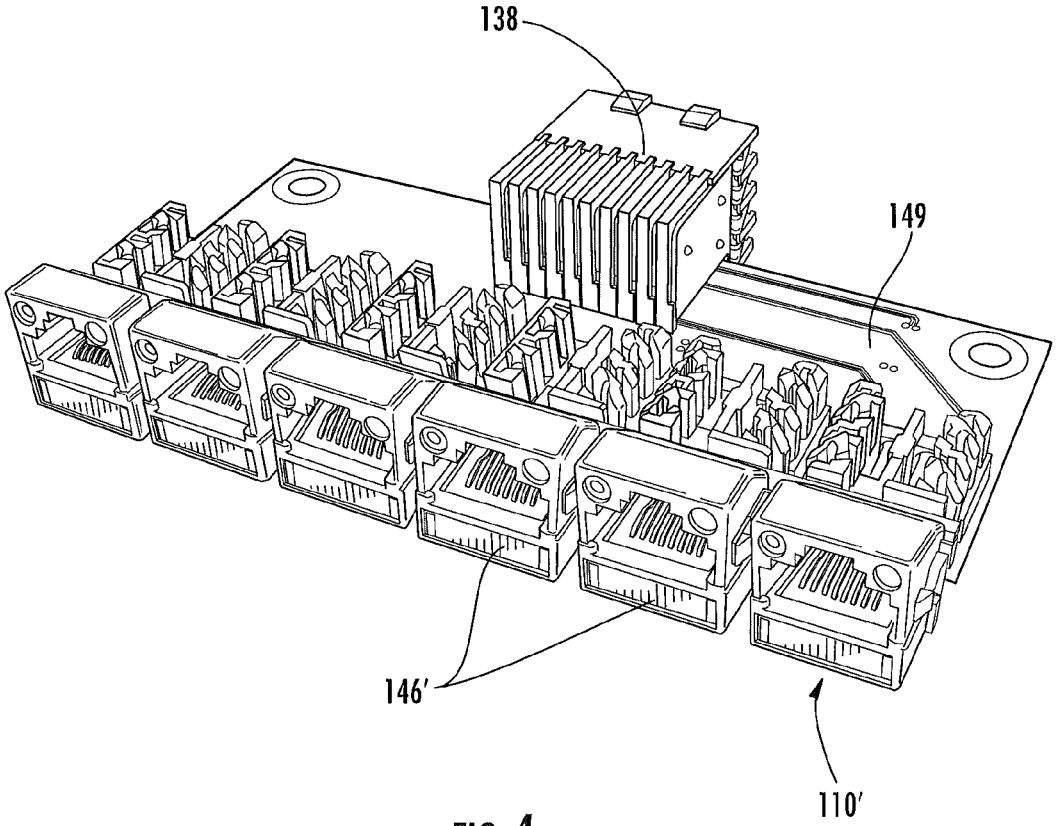
FIG. 4 is a perspective view of a module similar to that of FIG. 2 with the housing removed.

FIG. 4 illustrates an embodiment of a module 110' (shown with the housing removed) in which six, rather than four, RJ-45 jacks 146' are included, although the discussion below is equally applicable to the module 110 and its four RJ-45 jacks 146. As can be seen in FIG. 4, the RJ-45 jacks 146' are mounted on a printed wiring board 149, which interconnects them via traces thereon to the connector 138, which in this embodiment is a backplane connector. Backplane connectors are discussed in some detail in U.S. patent application Ser. No. 12/763,410, supra, and need not be discussed in detail herein. In the module 110' or a similar module 110, one or more of the backplane connector 138, printed wiring board 149 and RJ-45 jacks 146' includes crosstalk compensation features (such as wire trace crossovers, capacitors, inductors and the like) that provide an acceptable level of crosstalk for Category 6A performance. As such, similar crosstalk compensation components may not be required for the termination module 123 and cable 122. In such an instance, components are needed within the termination module 123 to interconnect the conductors 126 of the cable 122 with the connector 134.

Figure 5A:
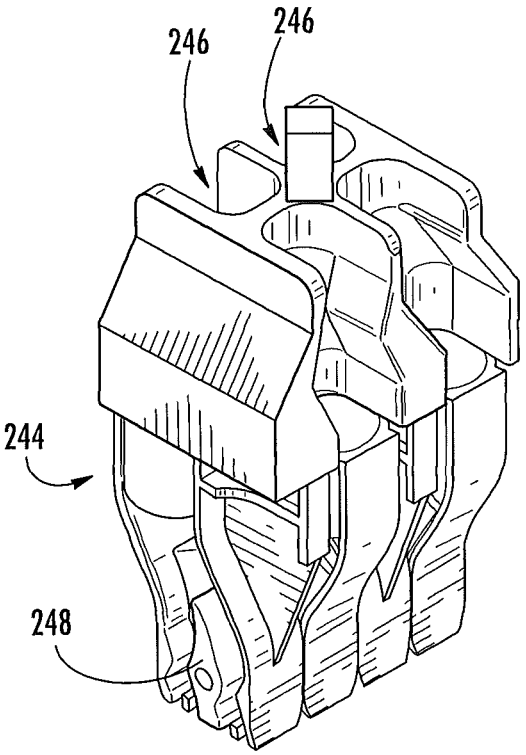
FIG. 5A is a perspective view of a cable termination sled useful for the cable of FIG. 3A.
Figure 5B:
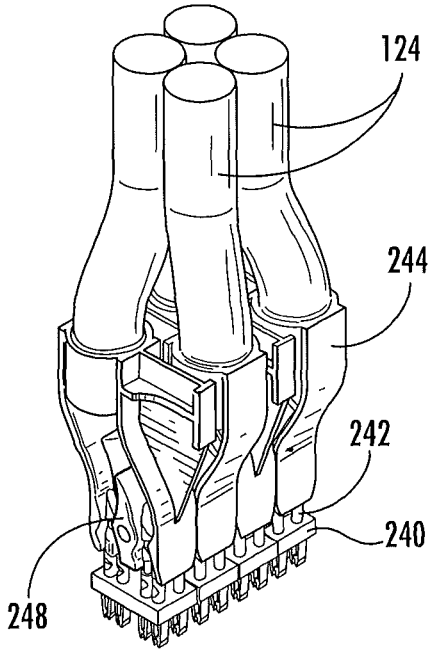
FIG. 5B is a perspective view of the cable termination sled of FIG. 5 with the cable inserted.
Figure 6:
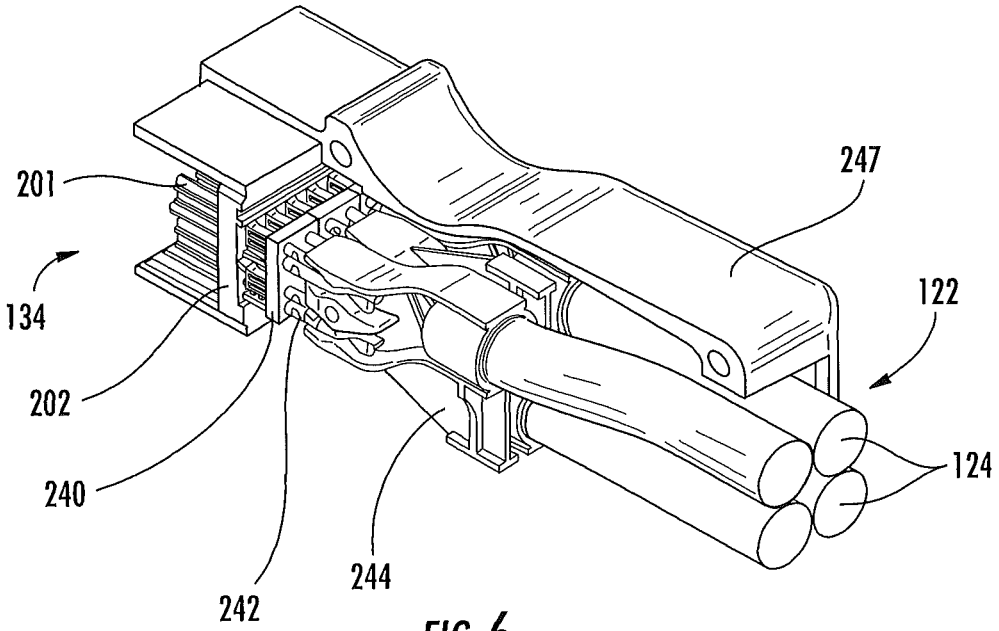
FIG. 6 is a perspective view of the cable and cable sled of FIG. 5B attached to a connector.

In one exemplary configuration, the connector 134 has contacts 201 that have a post or pin on one end and an "eye-of-the-needle" configuration on the opposite end, with the contacts 201 being mounted in a substrate 202 (see FIG. 6). Interconnection of the conductors 126 of the cable 122 with the eye-of-the-needle contacts can be achieved in a number of ways. As seen in FIGS. 5B and 6, small panels 240 may be provided for the mounting of transition elements 242 that connect the ends of the conductors 126 to the eye-of-the-needle portions of the contacts 201. A cable subunit routing sled, manager or adapter 244 (FIG. 5A) may be included to assist with the division and routing of the individual subunits 124 of the cable 122. The routing sled 244 includes routing channels 246 that have longitudinal axes that are offset from the longitudinal axes of their neighboring channels 246 in both the X- and Y-directions, and that guide the subunits 124 into individual quadrants. Guides 248 are present in each routing channel 246 that help to separate the individual conductors 126 into desired positions. From these locations, the conductors 126 can be connected with the transition elements 242 that are, in turn, connected to the eye-of-the-needle ends of the contacts 201. A housing 247 covers the end of the cable 122, the sled 244, the panels 240, the transition elements 242 and the periphery of the connector 134. In some embodiments, the sled 244 (and other sleds described below) may also provide electromagnetic shielding that can help to reduce crosstalk between cable subunits and between conductor pairs of the same subunit, and/or may include strain relief elements.

Figure 7A:
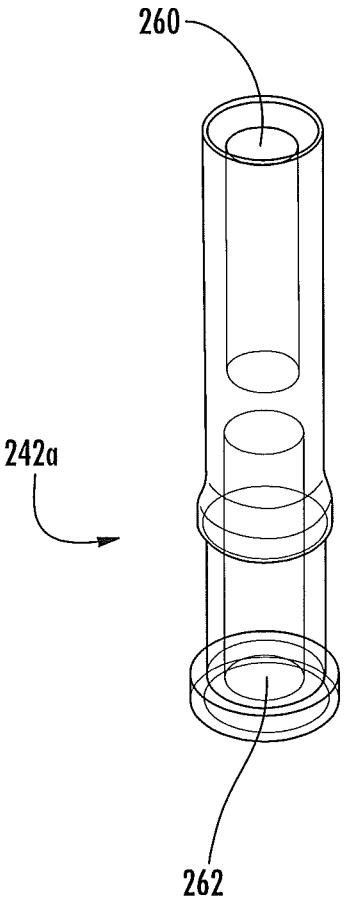
FIG. 7A is a perspective view of an element for attaching a cable conductor to a connector contact that may be employed with the cable and connector of FIG. 6.
Figure 7B:
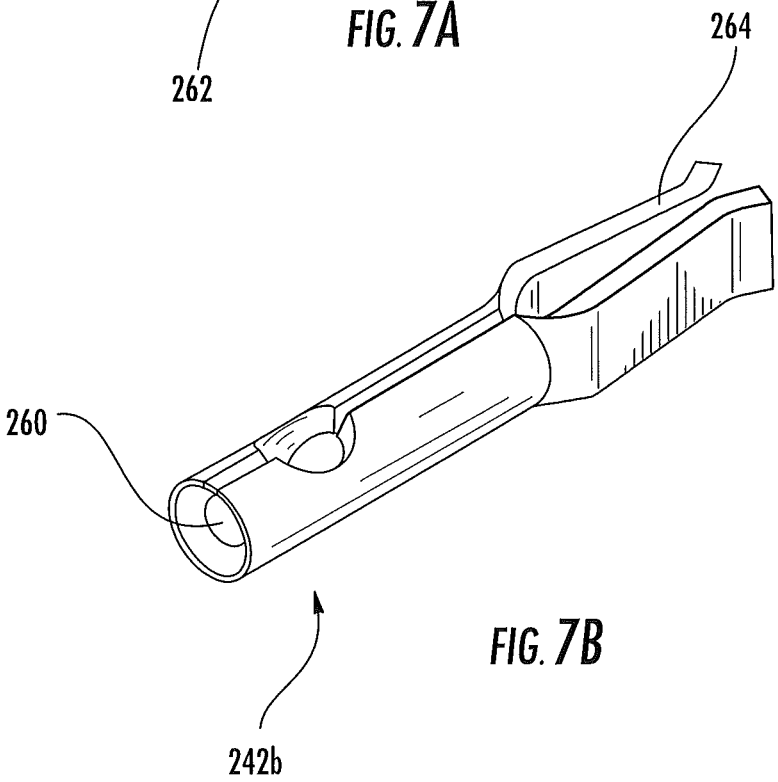
FIG. 7B is a perspective view of an alternative embodiment of an element for attaching a cable conductor to a connector contact that may be employed with the cable and connector of FIG. 6.
Figure 7C:
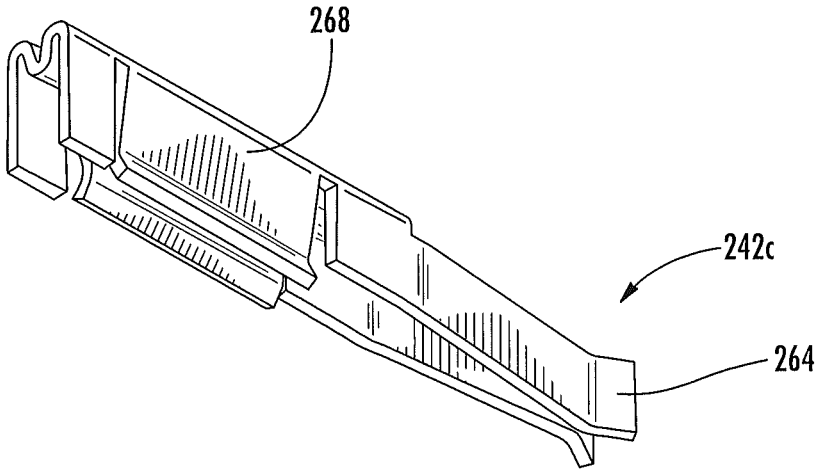
FIG. 7C is a perspective view of an alternative embodiment of an element for attaching a cable conductor to a connector contact that may be employed with the cable and connector of FIG. 6.

Referring now to FIGS. 7A-7C, different configurations for the transition elements 242 are shown therein. In FIG. 7A, the transition element 242*a* is an elongate cylinder with a bore 260 in one end that accepts a conductor 126 (typically via soldering) and a bore 262 at the opposite end that receives the eye-of-the-needle portion of the contact 201 in an interference fit. FIG. 7B illustrates a transition element 242*b* that similarly has a bore 260 at one end, but at the opposite end has two opposed jaws 264 that form a clip for connecting to the eye-of-the-needle portion of the contact 201. FIG. 7C illustrates a transition element 242*c* that has jaws 264 as described above, but has a crimpable slot 268 at its opposite end that can be crimped onto a conductor 126.

Figure 7D:
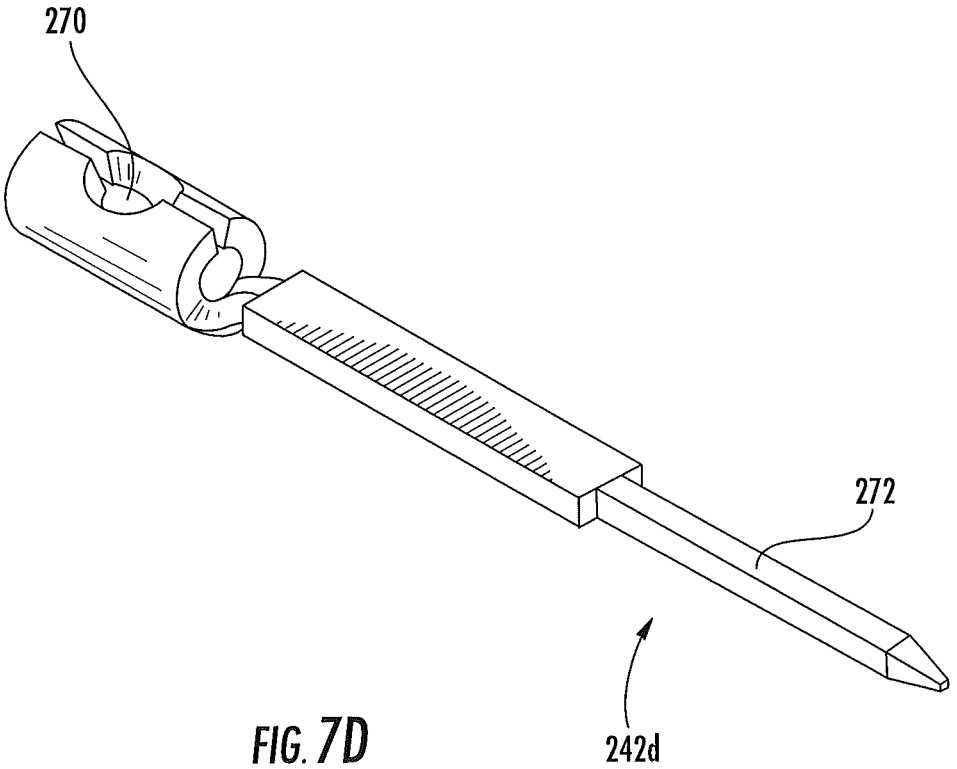
FIG. 7D is a perspective view of an element that attaches to a cable conductor and serves as a contact for a connector such as that shown in FIG. 6.

FIG. 7D illustrates an element 242*d* that combines the transition element 242*a* with the contact 201 in a single component. A bore 270 receives a conductor 126 (typically attached via soldering), and a pin 272 extends into the connector 134 to provide a contact for interconnection with the connector 138.

Figure 8:
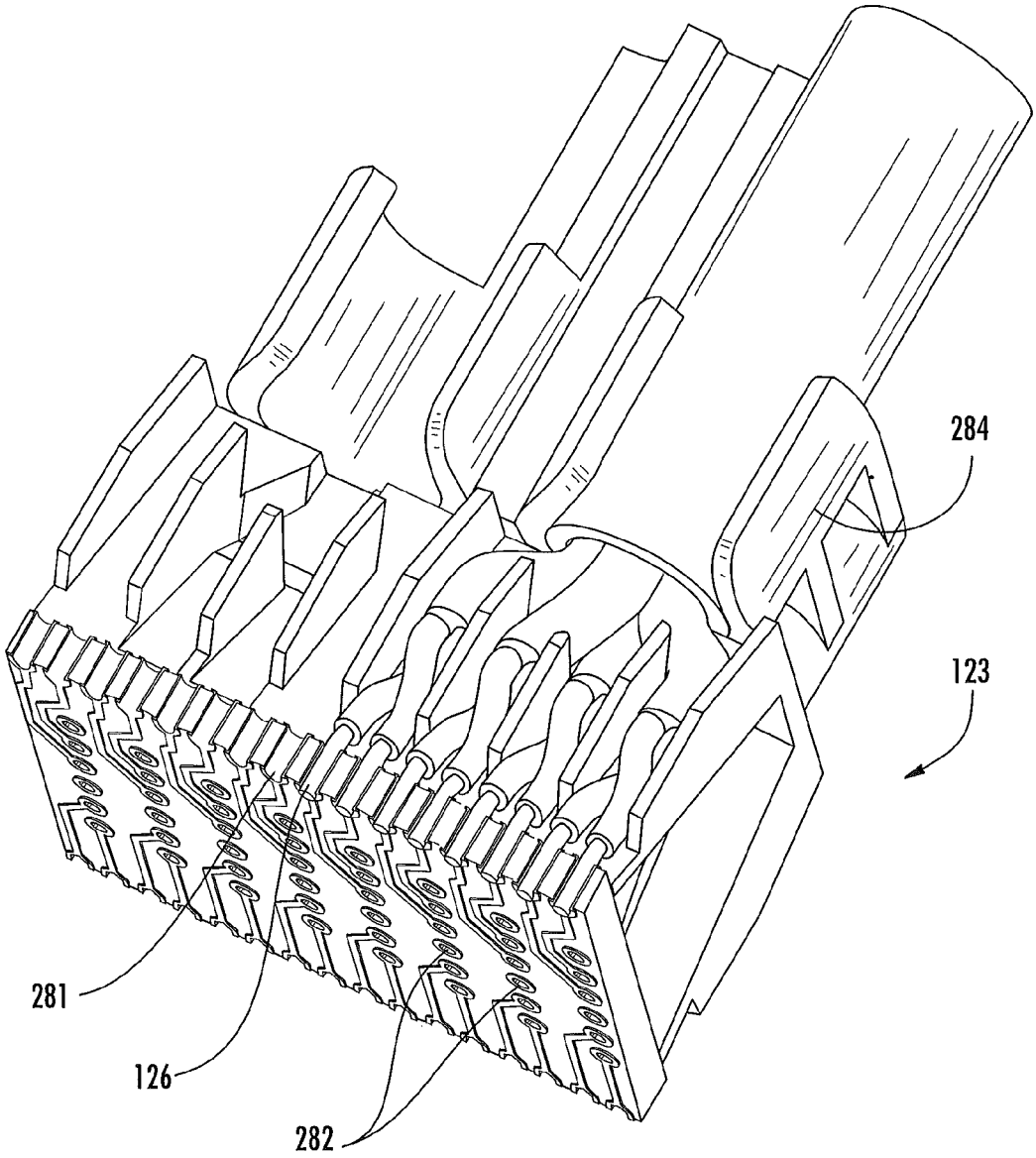
FIG. 8 is a perspective view of a circuit board and cable management sled that connects to the conductors of a cable like that of FIG. 3A.

FIG. 8 illustrates another configuration for the termination module 123. In this embodiment, the conductors 126 are soldered into open-ended "half-round" recesses 281 in a printed circuit board 280. The PCB 280 also has holes 282 in its surface that are connected with the recesses 281 (typically via electrical traces) and that are configured to receive "eye-of-the-needle" portions of the contacts 201 of the connector 134. A routing sled 284 with a series of channels and guides may be included to divide and route first the subunits 124, then the conductors 126, into desired positions. In some embodiments the recesses 281 are located on all sides of the PCB 280. The conductors 126 may pass through an adapter or manager prior to interconnection of the PCB 280.

Figure 9:
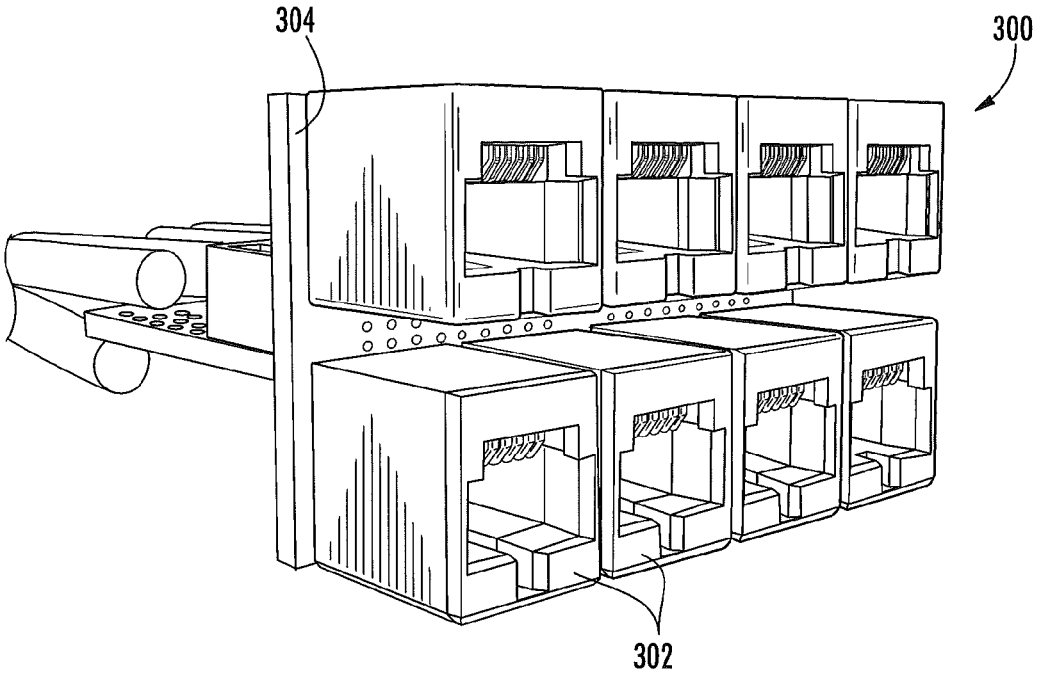
FIG. 9 is a perspective view of an alternative embodiment of a cable connector assembly in which connectors are arranged in two rows.
Figure 10:
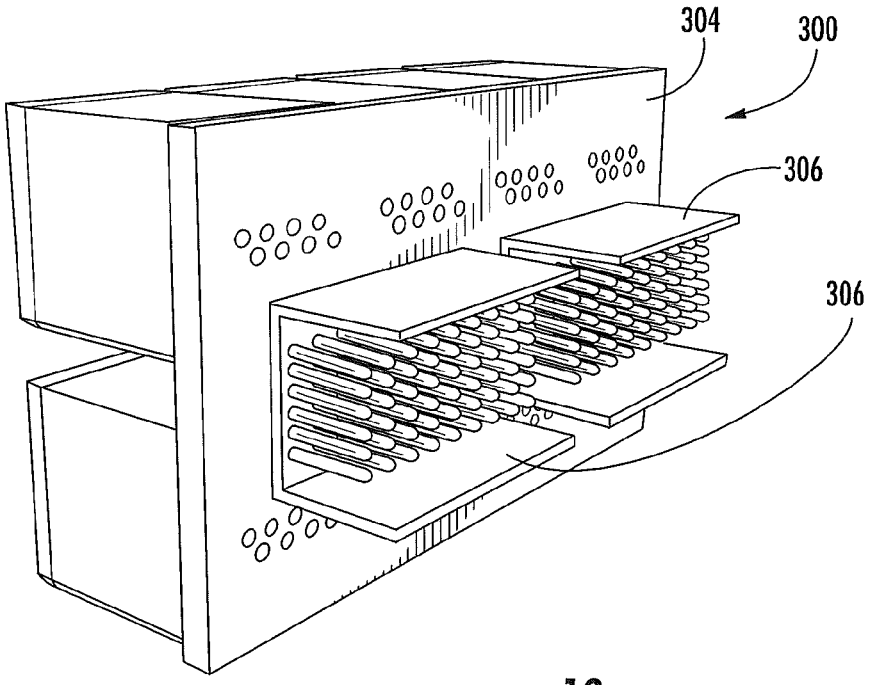
FIG. 10 is a rear perspective view of the module of FIG. 9.

FIG. 9 illustrates an embodiment in which a module 300 includes a vertically disposed PCB 304. In the embodiment shown in FIG. 9, two rows of RJ-45 jacks 302, each row having four connectors 302, are mounted on the PCB 304, although in other embodiments there may be only a single row of RJ-45 jacks 302. As can be seen in FIG. 10, connectors 306, each corresponding to a row of RJ-45 jacks 302, are mounted on the surface opposite the RJ-45 connectors 302.

Figure 11:
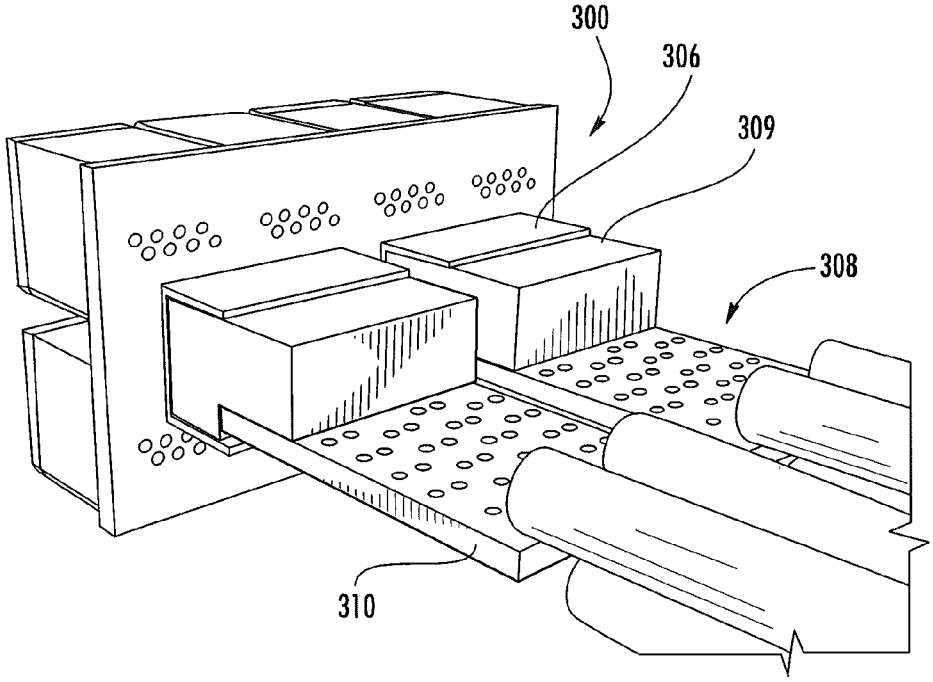
FIG. 11 is a rear perspective view of the module of FIG. 9 with schematically-depicted cables and connectors attached thereto.
Figure 12:
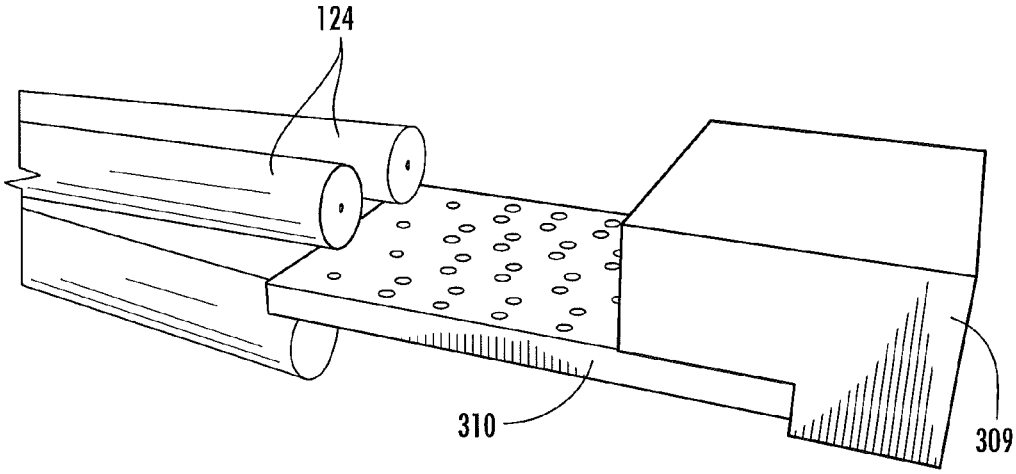
FIG. 12 is a perspective view of the schematically-depicted cable and connectors of FIG. 11.

As shown in FIG. 11 the connectors 306 of the module 300 mate with connectors 309 of termination modules 308 that are attached to cables 122. As shown in FIGS. 11 and 12, the termination module 308 includes a printed wiring board 310 that is used to interconnect the conductors 126 of the cable 122 to the contacts of the connector 309. In FIGS. 11 and 12, the actual interconnection of the conductors 126 and the PWB 310 is not illustrated for modeling simplicity. Different techniques and configurations for interconnecting the conductors 126 and the printed wiring board 310 are discussed below. It should also be noted that the termination module 308 may also be employed with a module having the configuration of module 110.

Figure 13A:
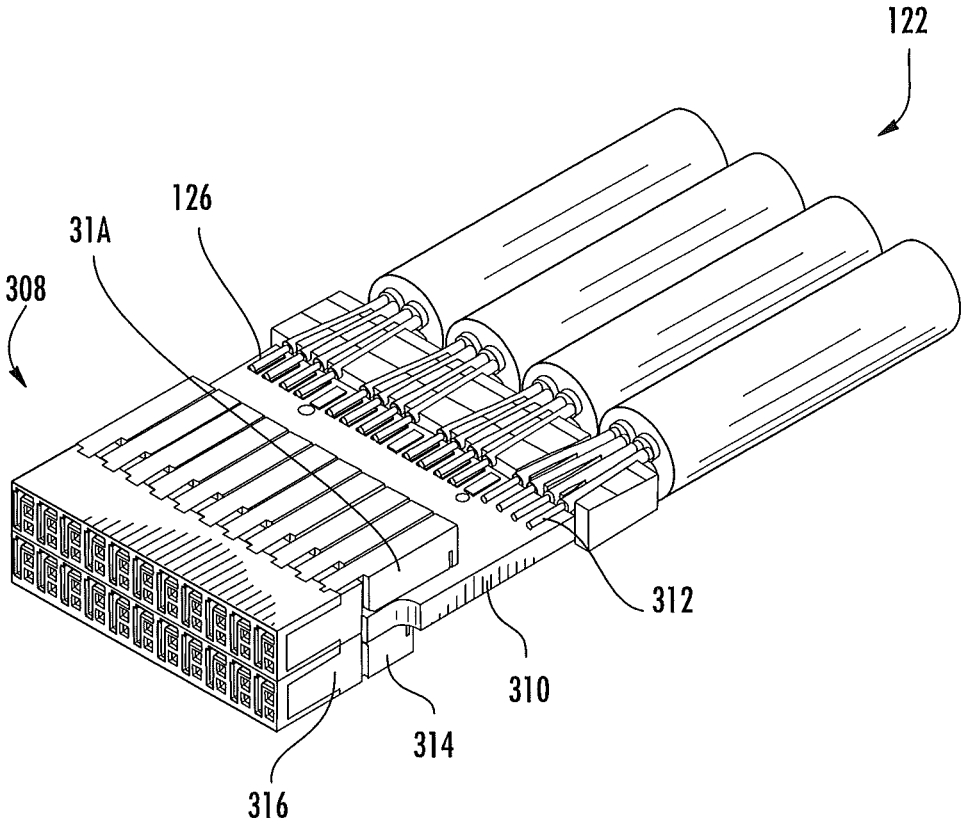
FIG. 13A is a perspective view of an alternative embodiment of a cable-connector assembly in which the conductors of the cable are attached to a circuit board that is in turn attached to a connector suitable for insertion into a module like that of FIG. 2.
Figure 13B:
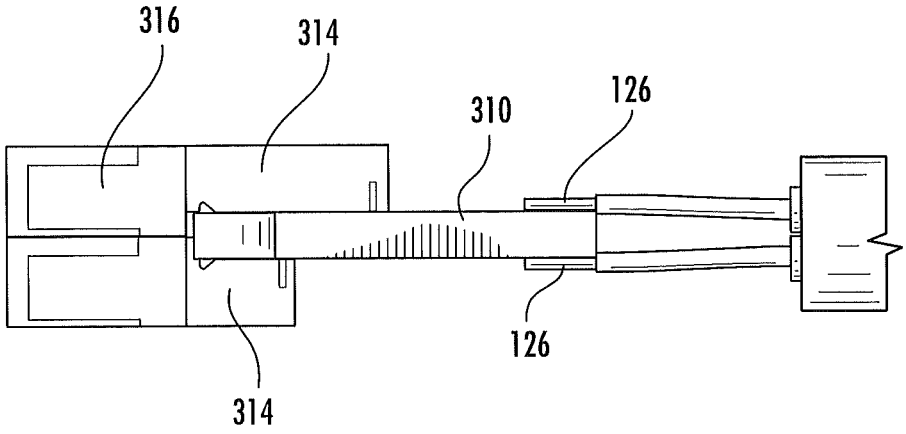
FIG. 13B is a side view of the assembly of FIG. 13A.
Figure 13C:
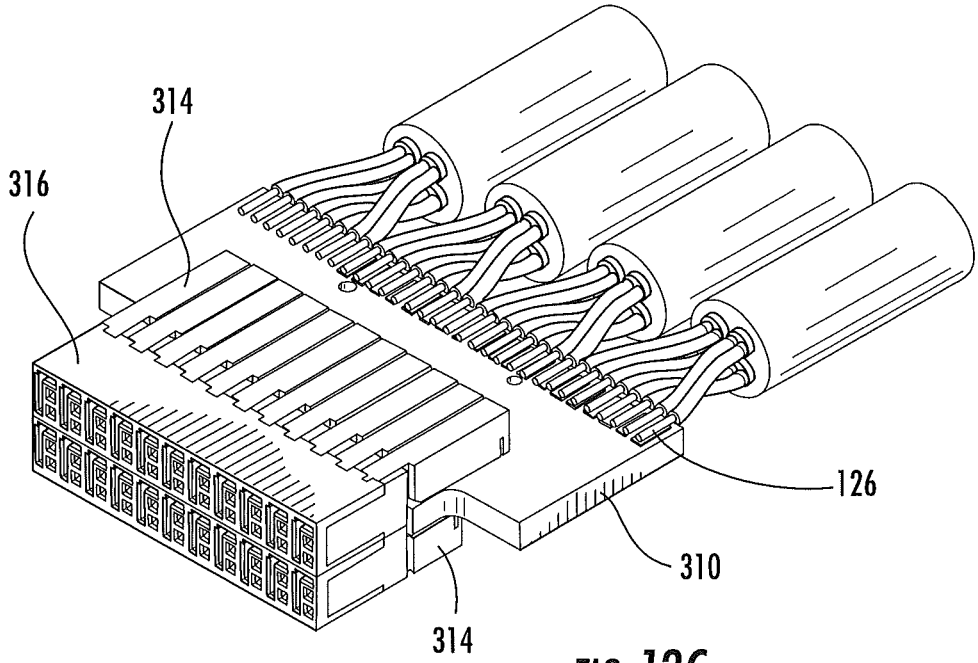
FIG. 13C is a perspective view of an alternative embodiment of the cable-connector assembly of FIG. 13A in which the conductors attach to one side of the circuit board.
Figure 13D:
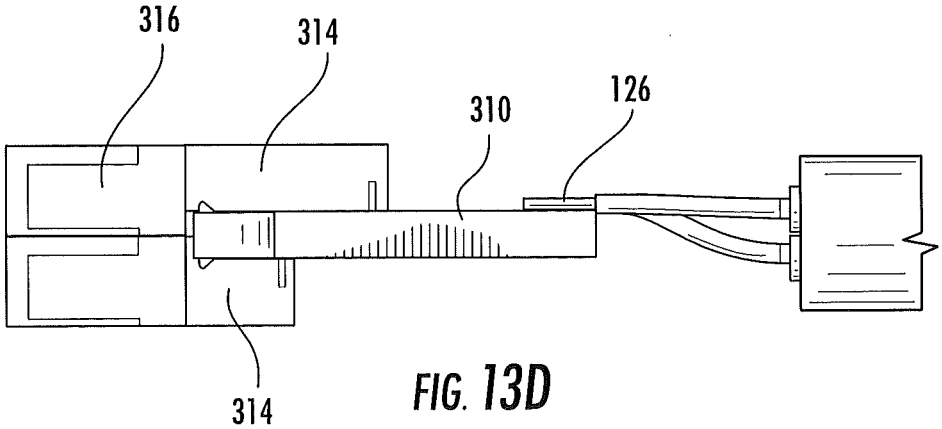
FIG. 13D is a side view of the assembly of FIG. 13C.

Turning first to FIGS. 13A-D and 14, the termination module 308 shown therein includes contact pads 312 on the PWB 310 to which the conductors 126 of the cable 122 are soldered. As shown in FIGS. 13A and 13B, the conductors 126 may be soldered on both the top and bottom surfaces of the PWB 310, or as shown in FIGS. 13C and 13D they may be soldered to only one side of the PWB 310. The PWB 310 is received between two blocks 314, each of which houses contacts that include eye-of-the-needle extensions that fit into apertures in the PWB 310. The opposite ends of the contacts in the blocks 314 are presented in a backplane connector 316 that mates with the connector 306 of the module 110 or the module 300.

Figure 14:
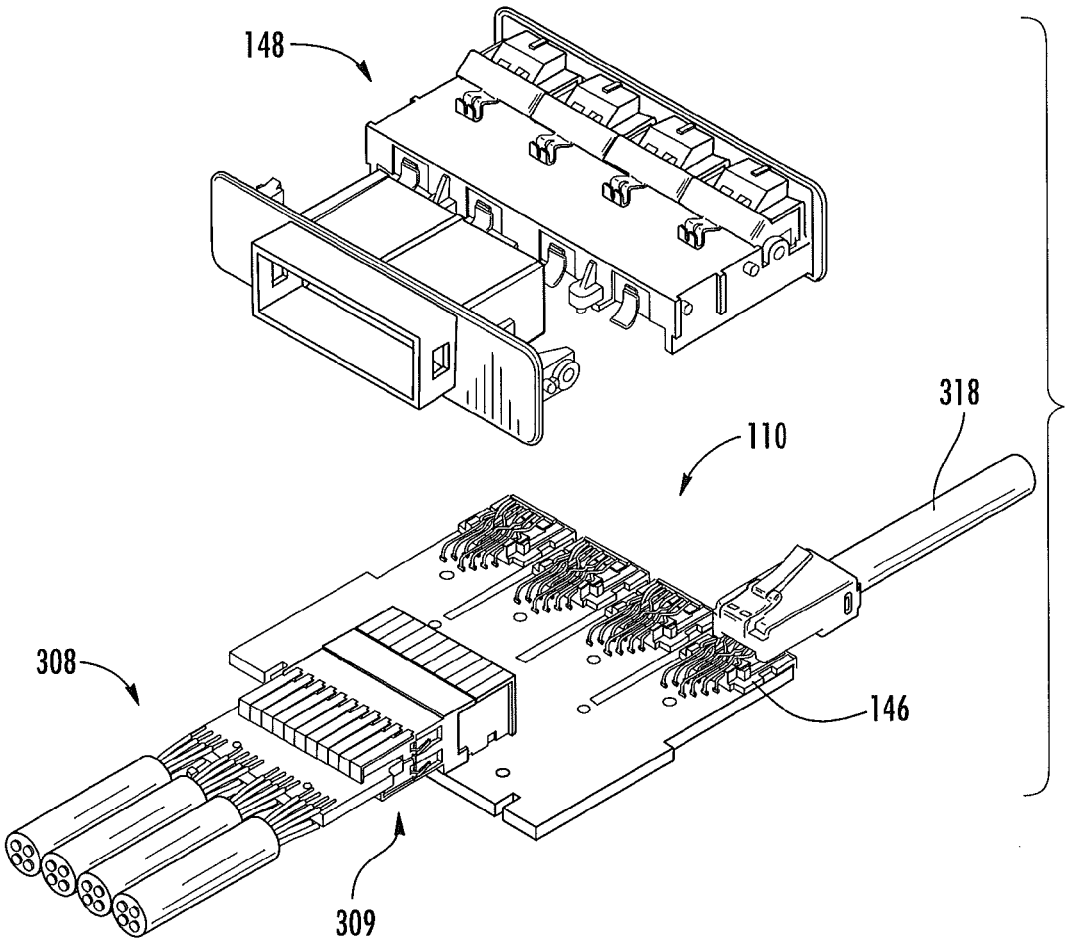
FIG. 14 is an exploded perspective view of the cable-connector assembly of 13A connected with an alternative embodiment of a module similar to that of FIG. 2, with the housing of the module removed for clarity.

FIG. 14 is a partially exploded view of the termination module 308 and the module 110 in which the housing 148 of the module 110 is exploded for clarity. In FIG. 14, the connector 309 of the termination module 308 is mated with the connector 138 of the module 110. An exemplary patch cord 318 is shown connected to one of the RJ-45 connectors 146 of the module 110.

Figure 15:
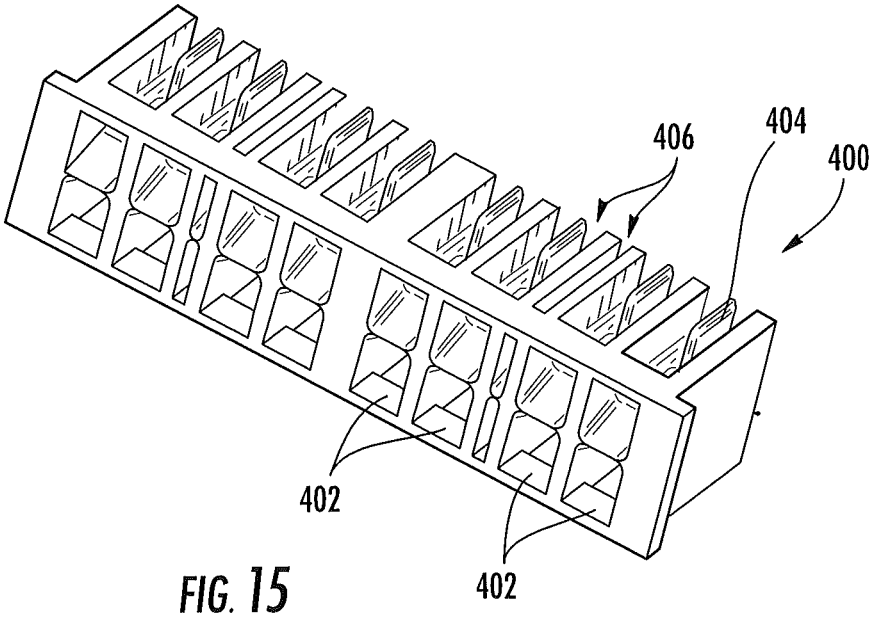
FIG. 15 is a perspective view of a cable manager for use with a cable like that of FIG. 14 that facilitates the attachment of conductors to solder pads of a printed circuit board.
Figure 16:
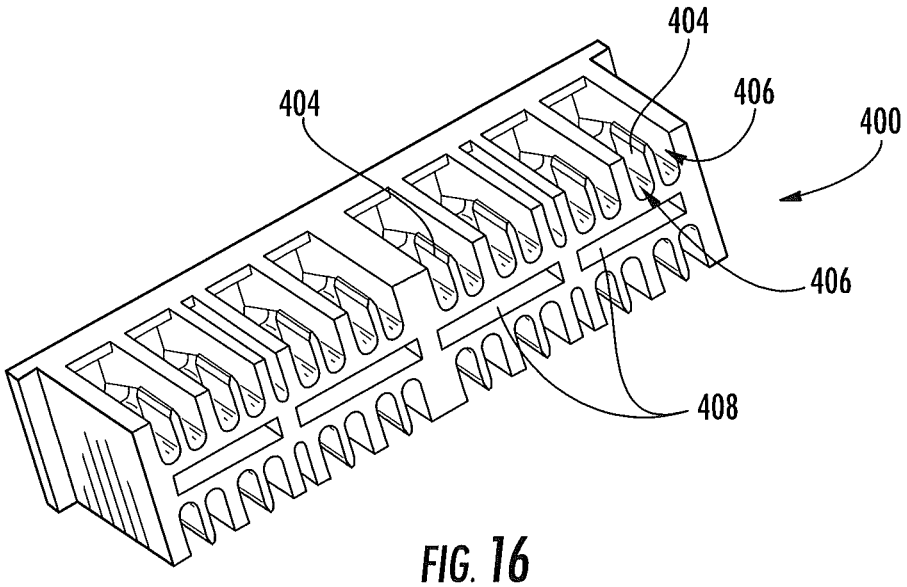
FIG. 16 is a rear perspective view of the cable manager of FIG. 15.
Figure 17:
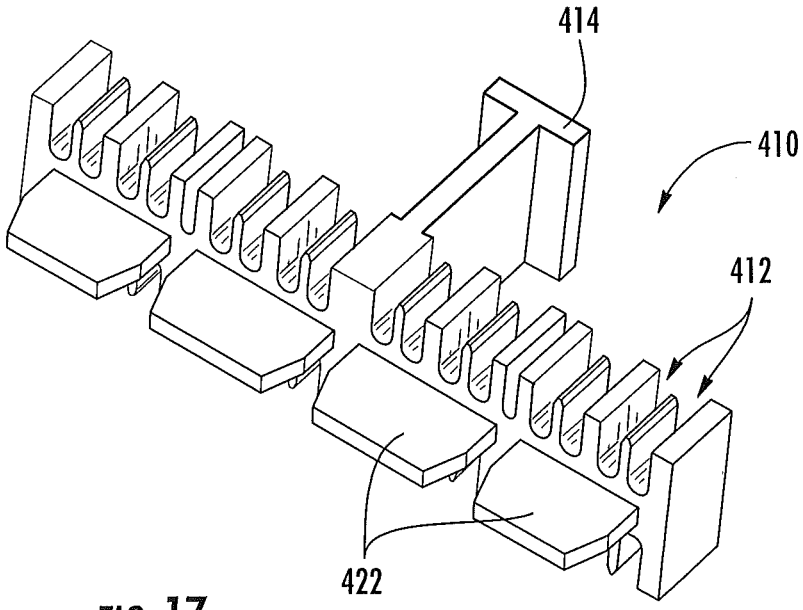
FIG. 17 is a perspective view of a comb that matches the cable manager of FIG. 15.
Figure 18:
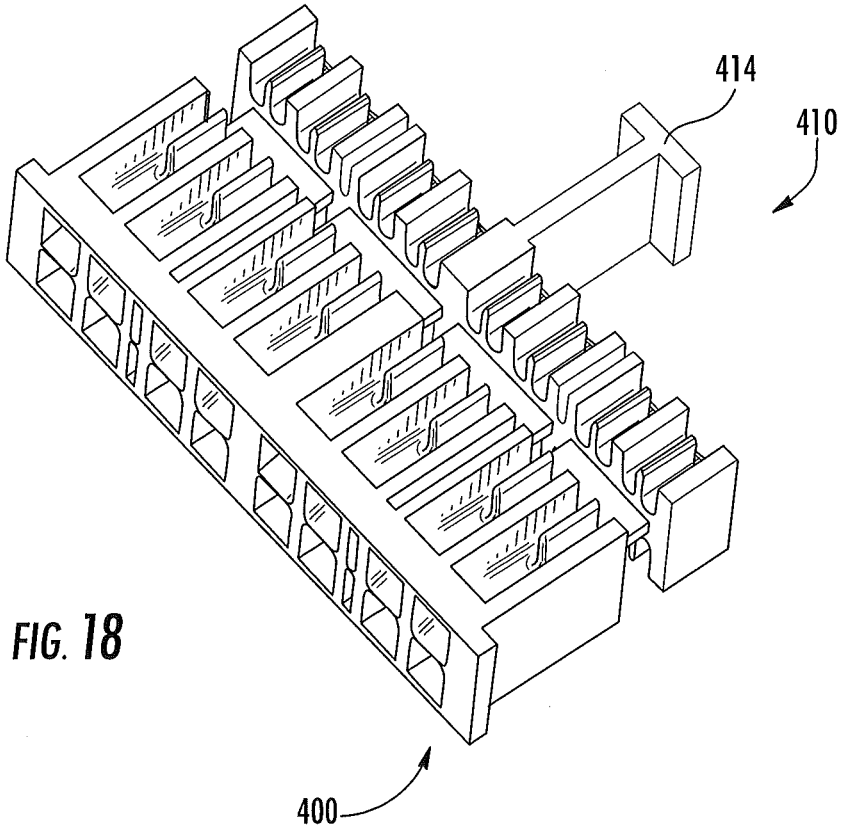
FIG. 18 is a perspective view of the comb of FIG. 17 mated with the cable manager of FIGS. 15 and 16.

In some instances, it may be advantageous to provide components that facilitate the soldering of the conductors 126 to the contacts 309 of the PWB 310. FIGS. 15 and 16 illustrate a wire manager 400 that can be inserted near the ends of the conductors 126. The wire manager 400 includes four sets of four channels 402, each channel 402 receiving a twisted pair of conductors 126. Within each channel 402 is a splitter post 404 that divides the channel 402 into two lanes 406, each of which is configured to receive a single conductor 126 and hold it in position. FIG. 17 illustrates a matching comb 410 that mates with the wire manager 400 via tabs 422 that are received in slots 408 in the wire manager 400. The comb 410 includes slots 412 that align with the lanes 406 of the channels 402 of the wire manager 400. A handle 414 facilitates handling of the comb 410. The mated wire manager 400 and comb 410 are shown in FIG. 18.

Figure 19:
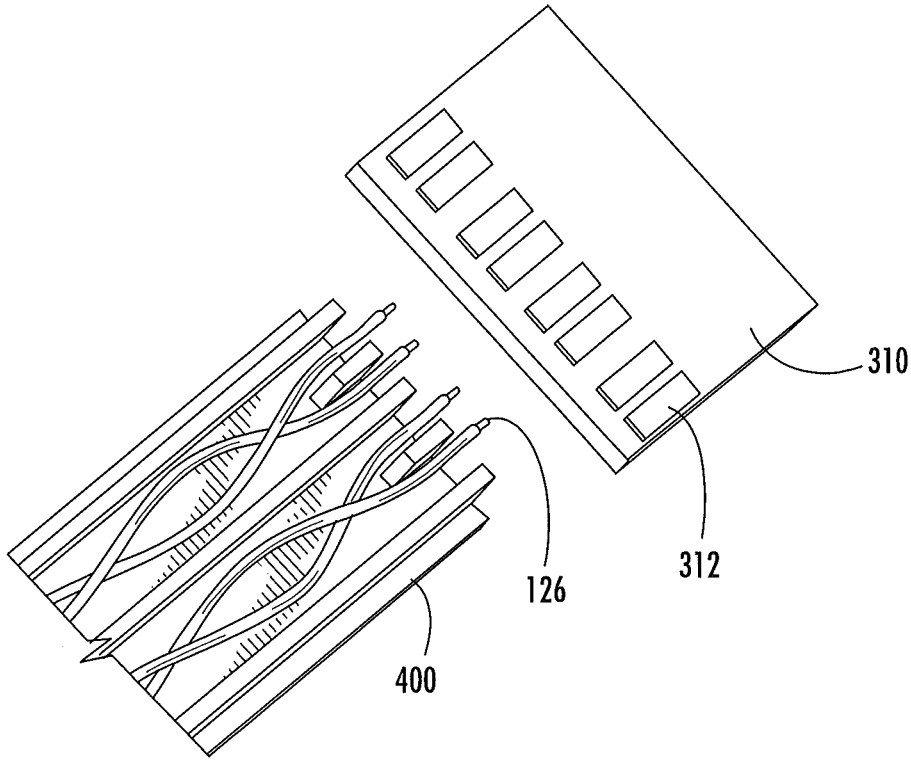
FIG. 19 is an enlarged, partially schematic, perspective view of the cable manager of FIGS. 15-18 with conductors inserted therein to demonstrate how attachment to a printed circuit board is facilitated.

In use, the conductors 126 are routed into their individual channels 402 and lanes 406, with the ends of the conductors 126 extending forwardly from the lanes 406. The comb 410 is then attached to the wire manager 400 so that the conductors 126 reside in the slots 412. Once the conductors 126 are positioned within the slots 412, the comb 410 is removed, leaving the conductors 126 aligned with the contact pads 312 of the PWB 310 of the termination module 308 (see FIG. 19). The conductors 126 can then be easily soldered to the contact pads 312.

Figure 22:
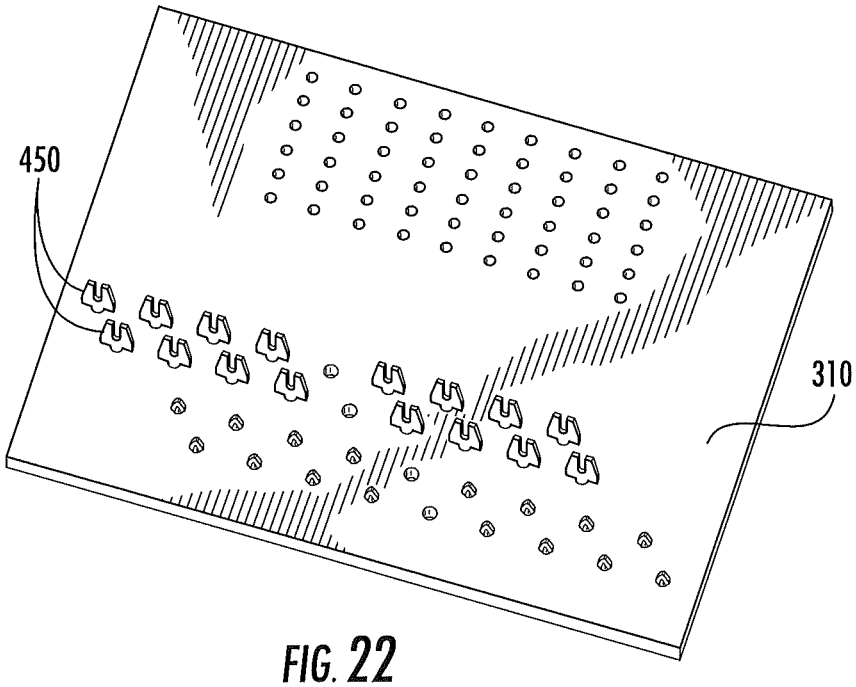
FIGS. 22-25 are perspective views that show alternative arrangements of IDCs on a printed circuit board that can be used with a cable of FIG. 14.
Figure 23:
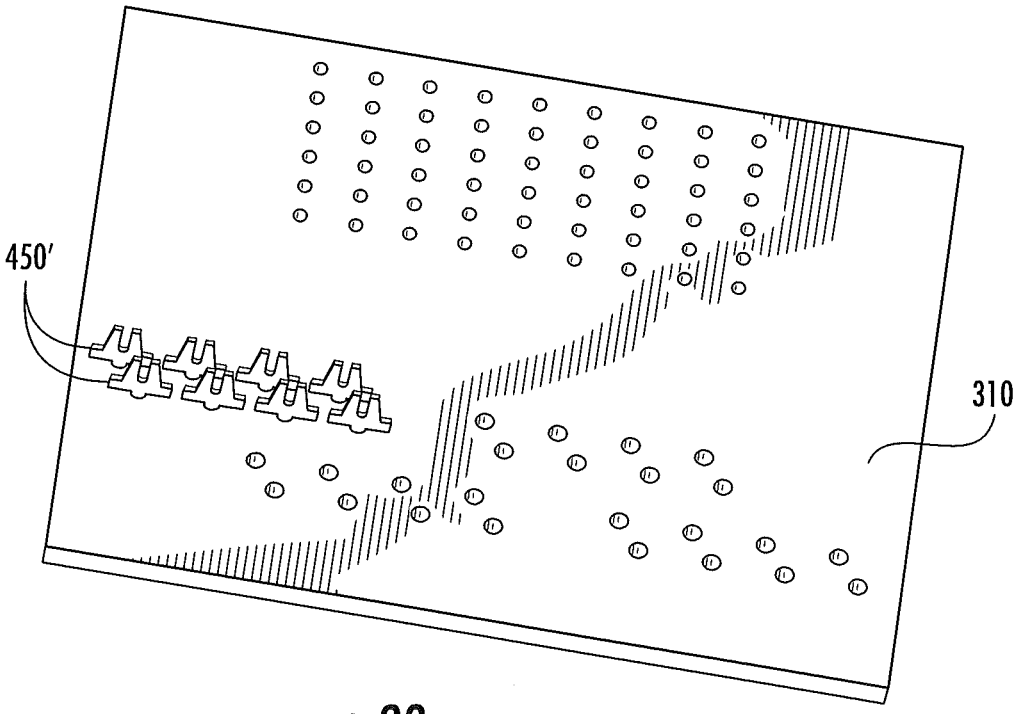
Figure 24:
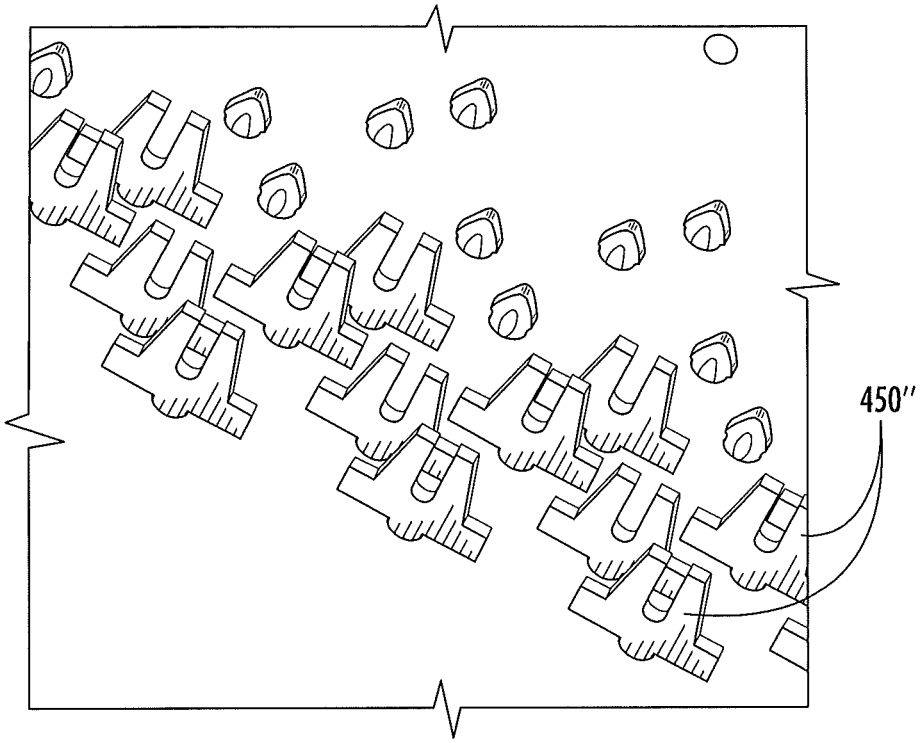
Figure 25:
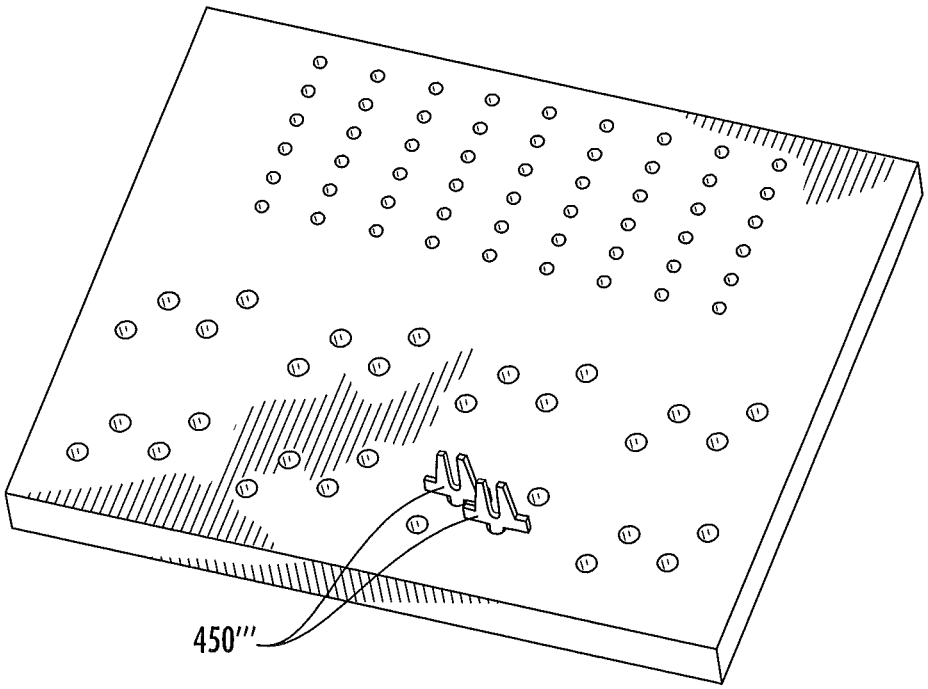

In other embodiments, the conductors 126 may be attached to the PWB 310 via insulation displacement contacts (IDCs). IDCs typically require more room on a PWB from side to side than do soldering contacts, so in some embodiments the IDC locations are offset, staggered or otherwise non-aligned in order to reduce the amount of room required. FIGS. 22-25 illustrate several different arrangements for IDCs 450 on the PWB 310. FIG. 22 illustrates an arrangement in which the IDCs 450 for a particular subunit 124 of conductors 126 are arranged in two rows, with the "back" row being staggered relative to the "front" row. In this arrangement the conductors 126 of two subunits 124 are connected on each side of the PWB 310, and the rows of IDCs on one side of the PWB 310 are offset forwardly from the rows of IDCs on the other side of the PWB 310. FIG. 23 illustrates a similar arrangement, but with the IDCs 450' in one row being non-uniformly staggered from the IDCs in the adjacent row. FIG. 24 illustrates an arrangement in which the IDCs 450" for a pair of conductors are positioned on a diagonal, with adjacent pairs defining diagonals that are perpendicular to each other. FIG. 25 illustrates a similar IDC pattern to that of FIG. 24, with the exception that the diagonal lines defined by the pairs of IDCs 450''' are parallel to each other.

Figure 26:
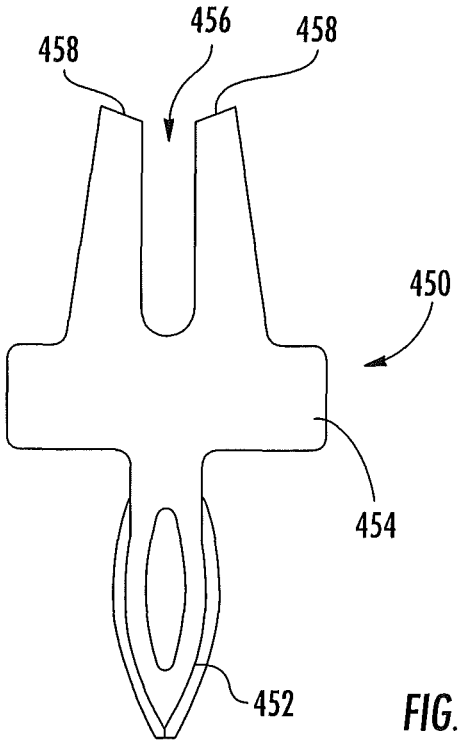
FIG. 26 is a front view of an exemplary IDC such as are shown in FIGS. 22-25.
Figure 27:
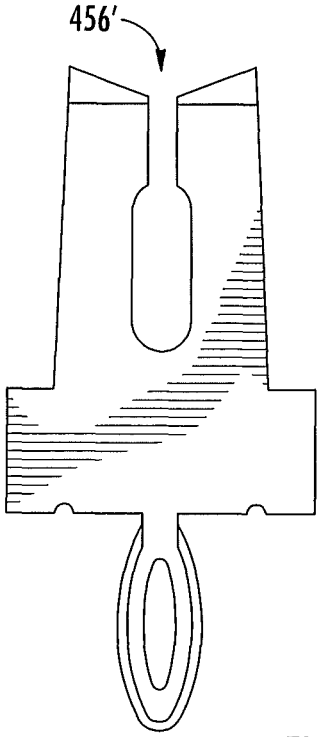
FIG. 27 is a front view of an alternative embodiment of an IDC.

FIG. 26 shows an exemplary IDC 450. This IDC includes an "eye-of-the-needle" extension 452, ears 454 to facilitate press-in insertion, a slot 456, and upper edges 458 that are angled (in this instance approximately 70 degrees from vertical) to assist with conductor insertion. FIG. 27 shows an alternative IDC in which the slot 456' narrows at its upper end to retain a conductor therein.

Figure 20:
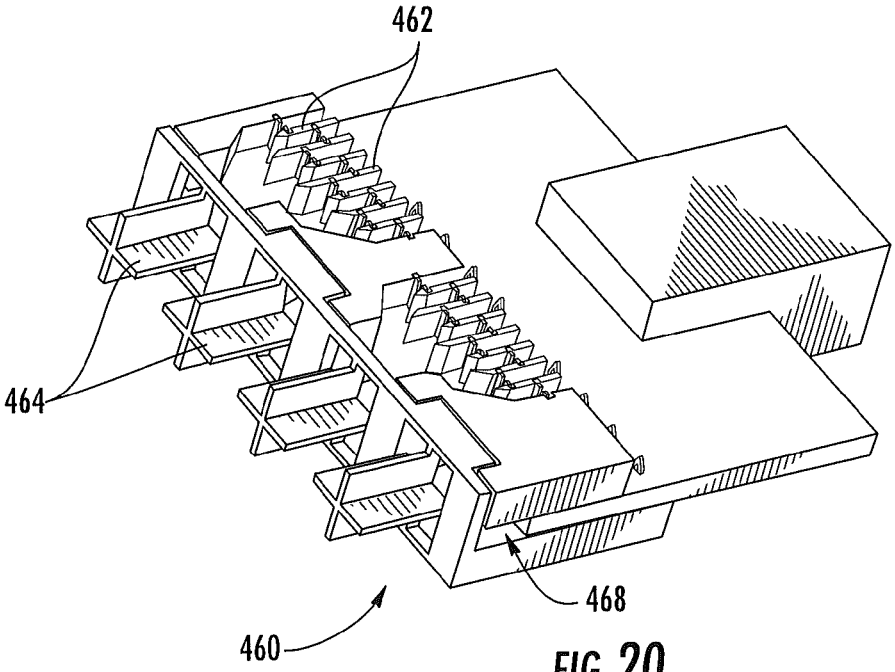
FIG. 20 is a perspective view of a cable manager for use with a cable of FIG. 14 that facilitates the attachment of conductors to IDCs on a printed circuit board.
Figure 21:
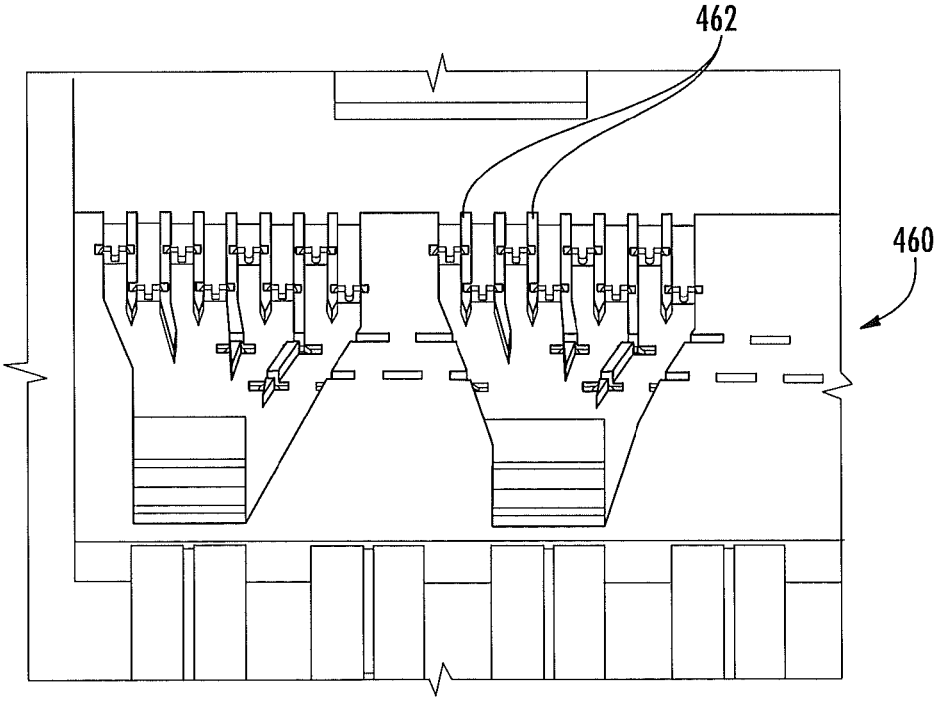
FIG. 21 is a top view of the cable manager of FIG. 20.

FIGS. 20 and 21 illustrate a wire manager 460 that can be employed with one or more of connectors 308 described above to facilitate routing of the conductors 126 from the cable 122 to the IDCs 450. The wire manager 460 includes a number of guides 462 that receive and route individual conductors 126 to an IDC for insertion. In the illustrated embodiment, the wire manager 460 is configured to guide the conductors 126 of two cable subunits 124 to the top surface of the PWB 310 and the conductors 126 of the other two cable subunits 124 to the bottom surface of the PWB 310. The wire manager 460 also includes four cruciform guides 464 that help to route the pairs of conductors 126 from each subunit 124 to the guides 462. The wire manager 460 can be attached to the front edge of the PCB 310 via a slot 468.

Figure 28:
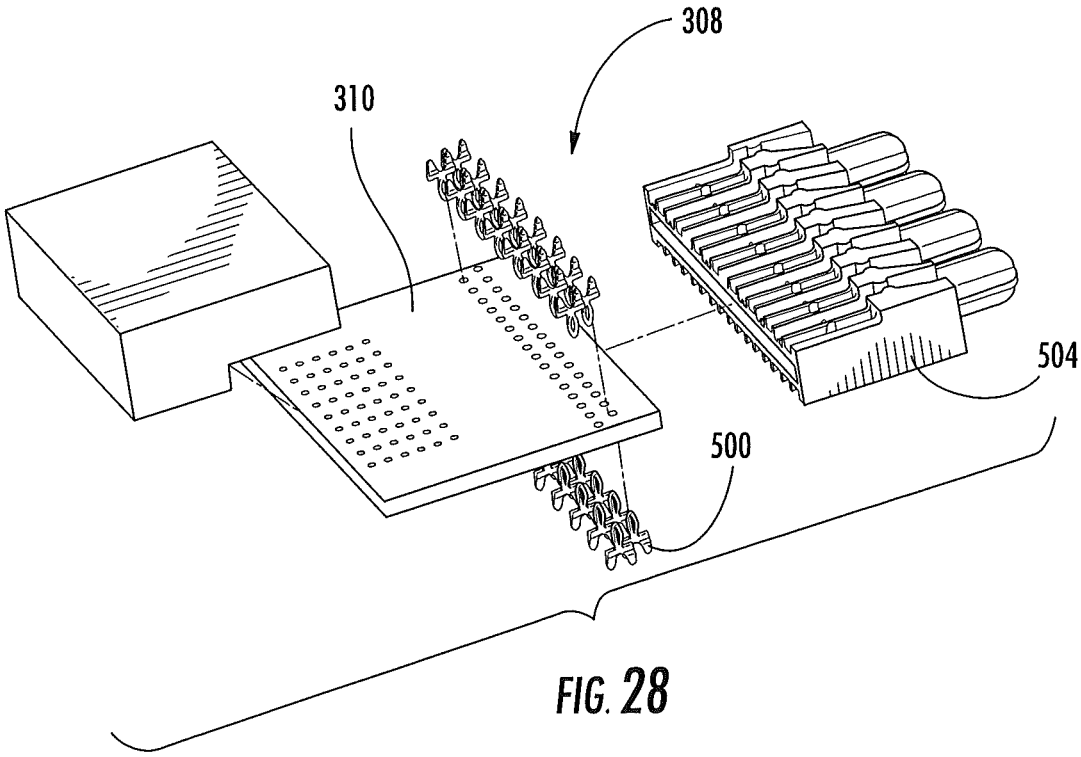
FIG. 28 is an exploded perspective view of a connector, printed circuit board, cable manager, and piercing contacts that may be attached to a cable of FIG. 14.
Figure 30:
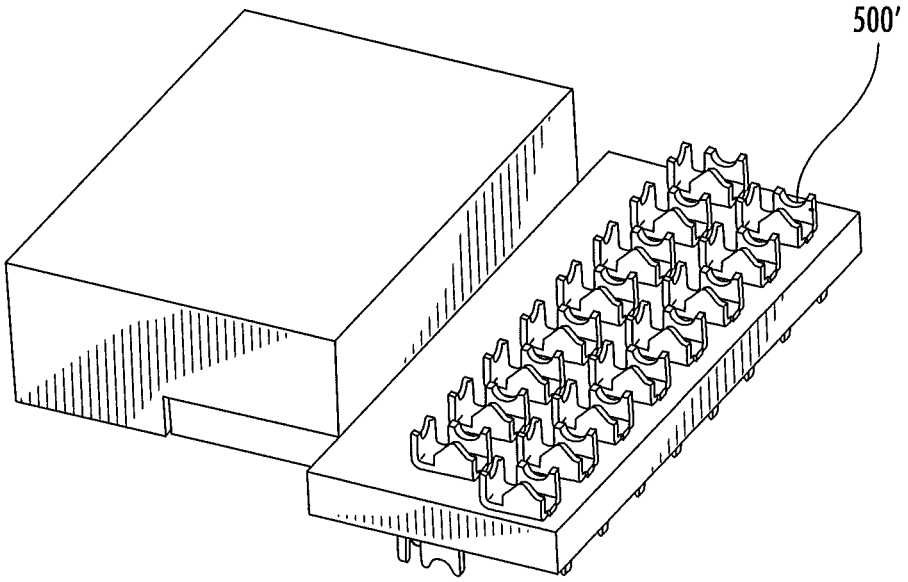
FIG. 30 is a perspective view of an alternative embodiment of a connector assembly employing piercing contacts.

Turning now to FIGS. 28 and 29, an exemplary termination module 308 that employs piercing contacts 500 is shown therein. The piercing contacts 500 are inserted into both sides of the PCB 310 in two rows, with the contacts 500 in one row being staggered relative to the contacts 500 of the other row. A wire managing sled 504 that slips onto the rear edge of the PWB 310 may also be included (see FIG. 19). Piercing contacts 500' of another configuration are illustrated in FIG. 30. In either instance, typically conductors 126 to be connected with the contacts 500, 500' are positioned over and pressed onto a piercing element (a point, blade or the like), and a crimping tool is employed to crimp arms, fingers, tabs or the like over the conductor to hold the conductor in place.

Figure 31A:
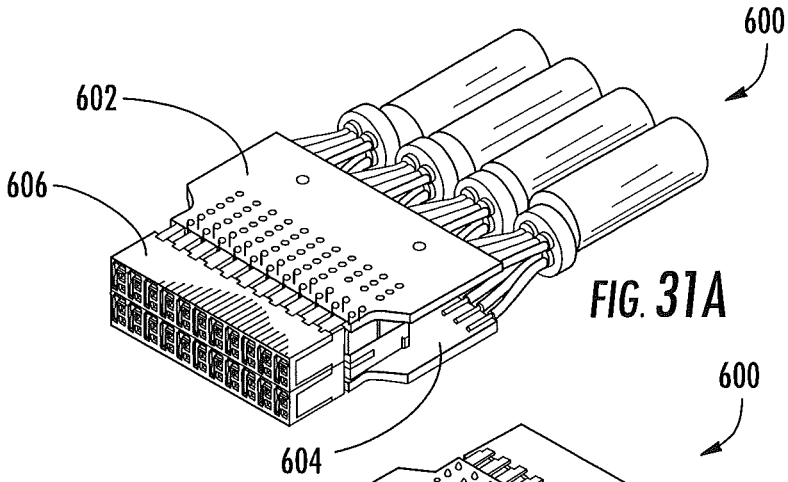
FIG. 31A is a perspective view of an alternative embodiment of a cable-connector assembly that employs two circuit boards to attach the conductors to the connector.
Figure 31B:
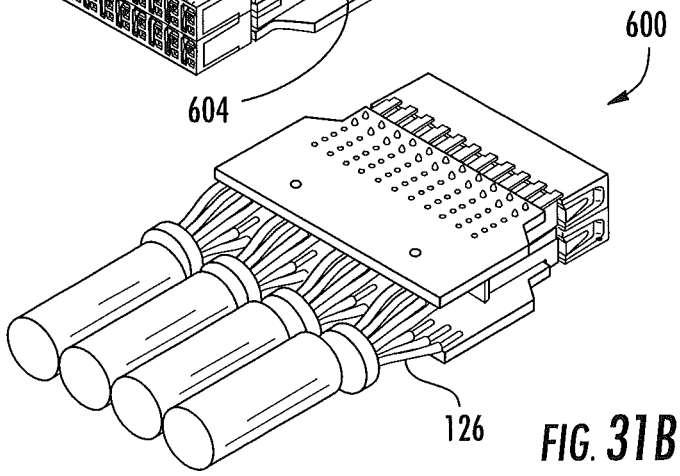
FIG. 31B is a rear perspective view of the cable-connector assembly of FIG. 31A.
Figure 32A:
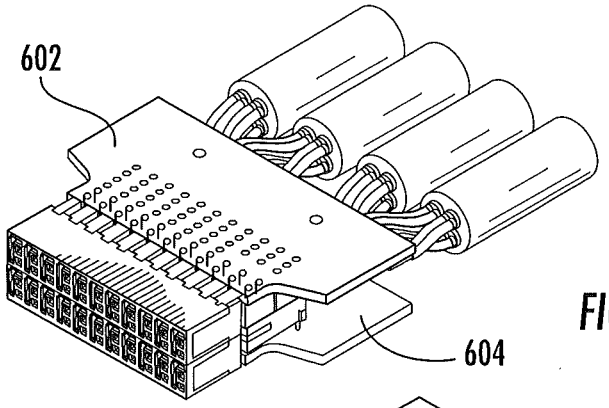
FIG. 32A is a perspective view of an alternative embodiment of a cable-connector assembly that employs two circuit boards to attach the conductors to the connector.
Figure 32B:
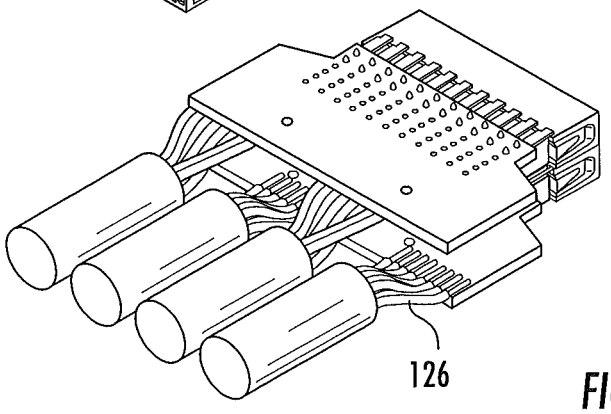
FIG. 32B is a rear perspective view of the cable-connector assembly of FIG. 32A.

Another embodiment of a termination module that can be attached to the cable 122, designated broadly at 600, is shown in FIGS. 31A-B and 32A-B. The termination module 600 includes two separate PWBs 602, 604 that are attached to a connector block 606, wherein the connector block 606 is matable with the connector 138 of the module 110. As shown in FIGS. 31A-B, the individual conductors 126 of the same subunit 124 of the cable 122 may be routed to both PWBs 602, 604, or the conductors 126 of the same subunit 124 may be routed to the same PWB 602, 604 (see FIGS. 32A-B). In either instance the conductors 126 may be connected with the PWBs 602, 604 via any of the techniques discussed above.

Figure 33A:
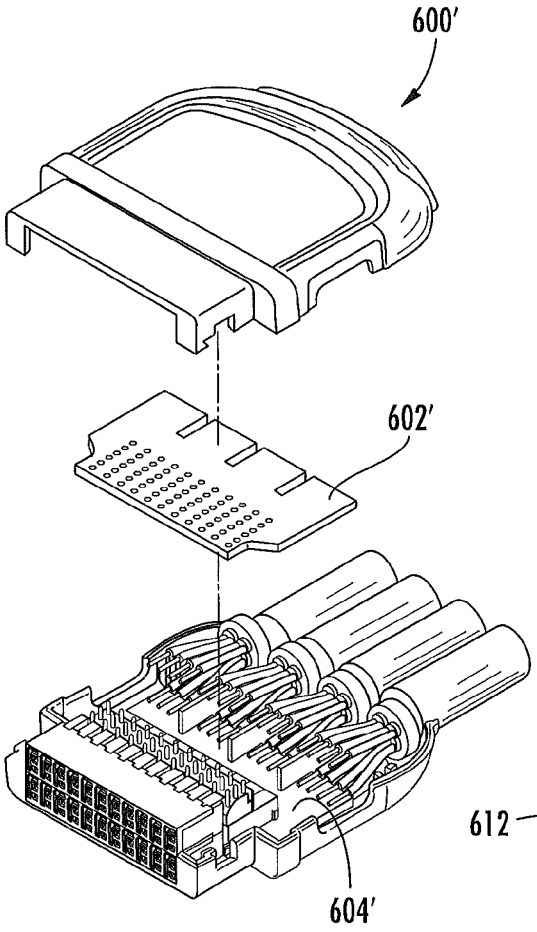
FIGS. 33A and 33B are exploded perspective views of the cable-connector module of FIG. 31A with the housing shown.
Figure 33B:
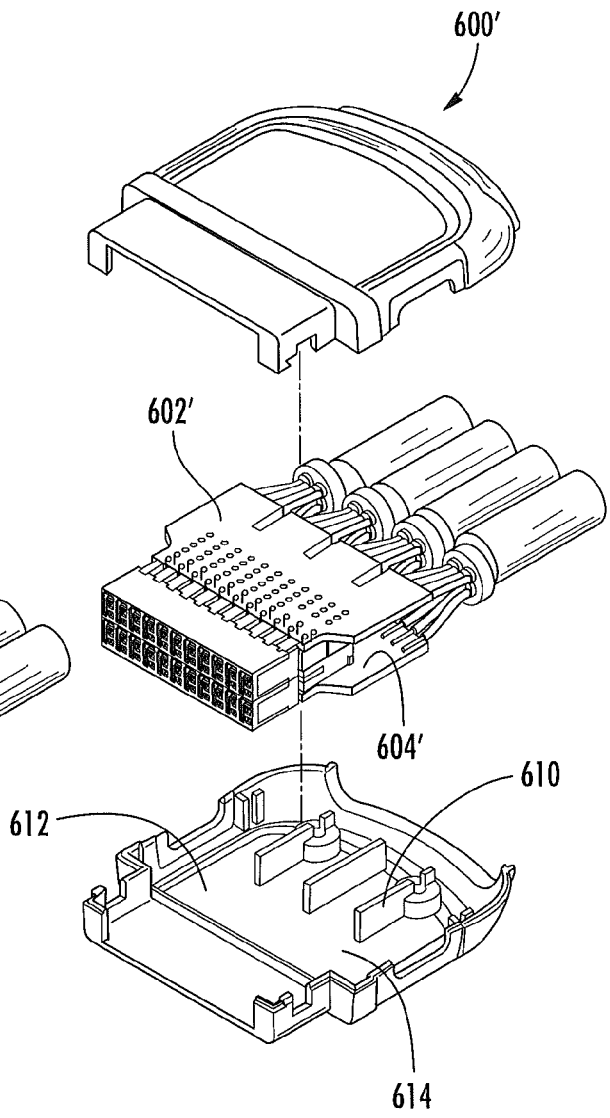

FIGS. 33A-B illustrates a modified connector 600'. The connector 600' includes PWBs 602', 604' with edge slots 608 that can receive shielding ribs 610 that depend from the main surface 612 of the housing 614. The shielding ribs 610 can provide shielding for the subunits 124, which may reduce crosstalk and other performance-hampering factors.

Figure 34A:
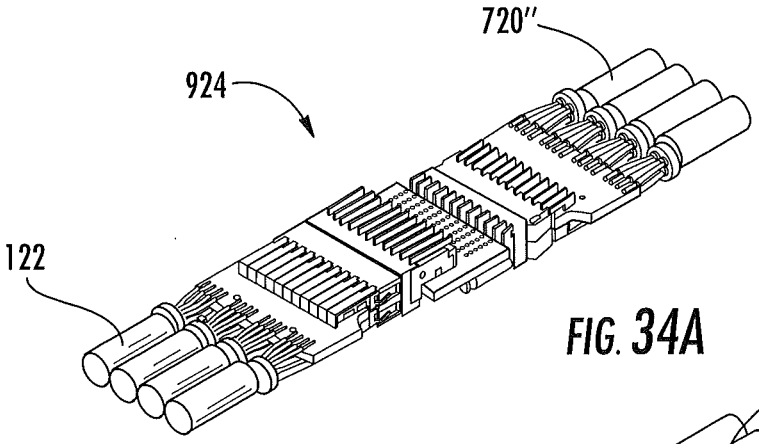
FIGS. 34A and 34B are perspective views of an assembled and disassembled cable-connector assembly, extension cable and adaptive coupler.
Figure 34B:
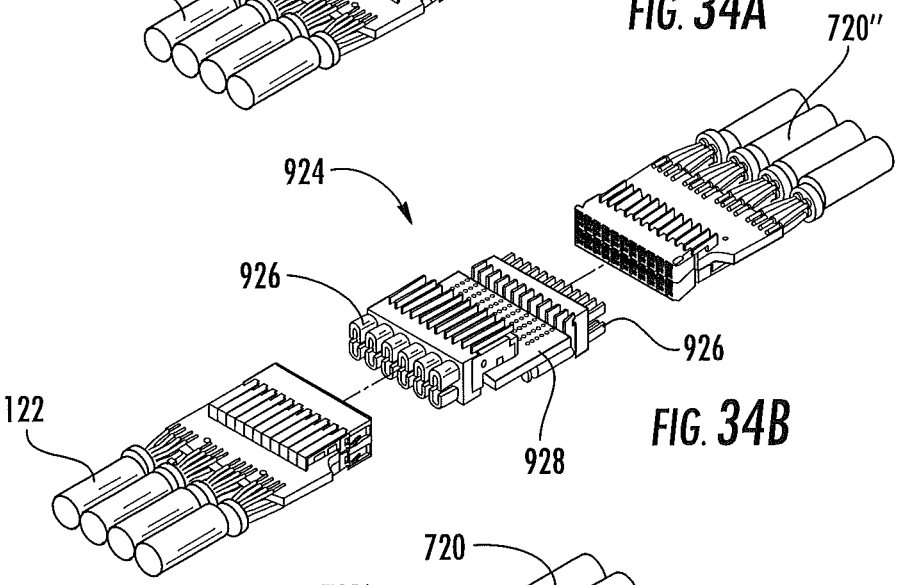
Figure 35A:
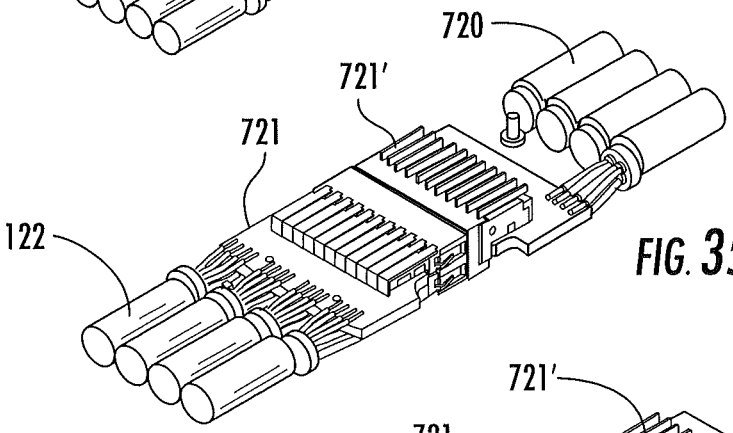
FIGS. 35A and 35B are perspective views of an assembled and disassembled cable-connector assembly with an extension cable.
Figure 35B:
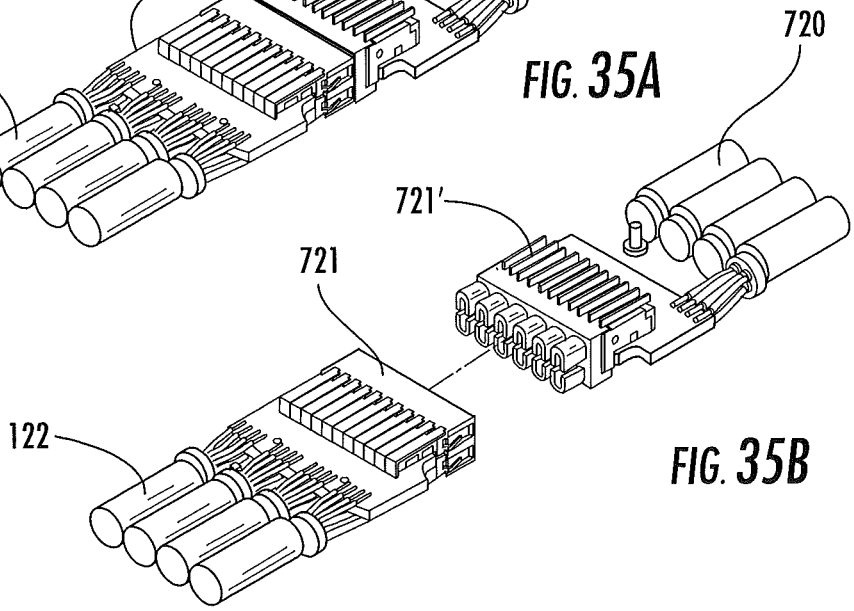
Figure 36A:
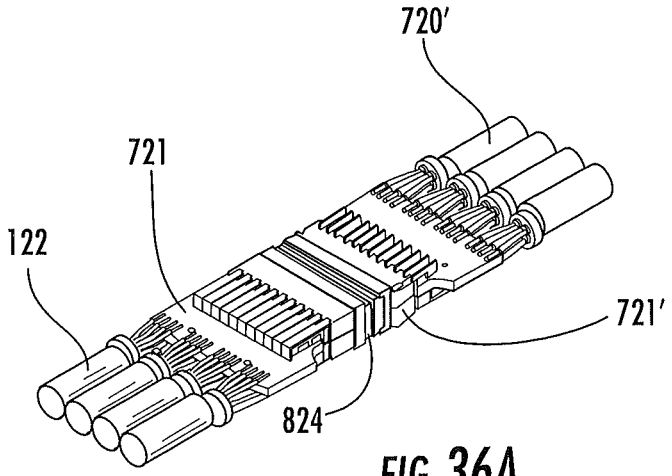
FIGS. 36A and 36B are perspective views of an assembled and disassembled cable-connector assembly, extension cable and adaptive coupler.
Figure 36B:
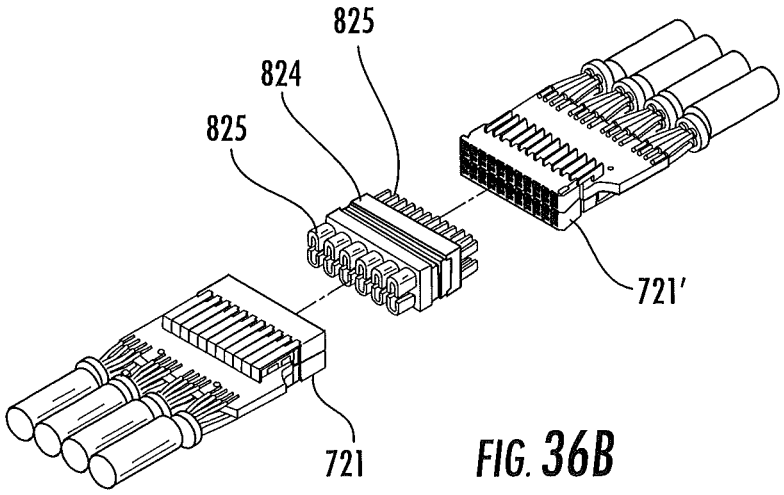

The cables 122 described above may, in some instances, be interconnected via connectors and cables to other components. In some instances, it may be necessary or desirable to provide an extension cable that enables modules connected to a cable 122 to be interconnected with other components at the end opposite the termination module 308. FIGS. 34A-36B are directed to termination configurations for cables 122 and extension cables 720, 720', 720". Such cables include termination modules that are designed to enable the cables of different modules or other components to be interconnected while having suitable "gender" (i.e., male or female connection) and polarity (i.e., proper connection of conductors and components for signal transmission). This can be achieved in multiple ways. FIGS. 35A and 35B illustrate a cable 122 and an extension cable 720, wherein the cable 122 has a "female" connector 721 (e.g., of the configuration of the connector 306) and the cable 720' has a "male" connector 721' (e.g., of the configuration of the connector 309) that mates directly with the female connector 721. In this embodiment, the female connector 721 and the male connector 721' are of opposite polarity (i.e., they are compatible for mating), as any rearrangement of conductors necessary for proper polarity is achieved within the termination module of the female connector 721, the male connector 721', or elsewhere in one of the cables. FIGS. 36A and 36B illustrate a cable 122 with a female connector 721 and an extension cable 720' that also has a female connector 721' of opposite polarity than female connector 721. In this embodiment, a coupler 824 with male connectors 825 extending in opposite directions is employed to interconnect the female connectors 821. Because the connectors 721, 721' are of opposite polarity, interconnection with the coupler 824 can provide proper polarity. FIGS. 34A and 34B illustrate a cable 122 and an extension cable 720", each of which has a female connector 721 of the same polarity. A coupler connector 924 includes a pair of opposed male connectors 926 that interconnect with the connectors 721. Proper polarity is achieved via a PCB 928 on which the connectors 926 are mounted.

Figure 37:
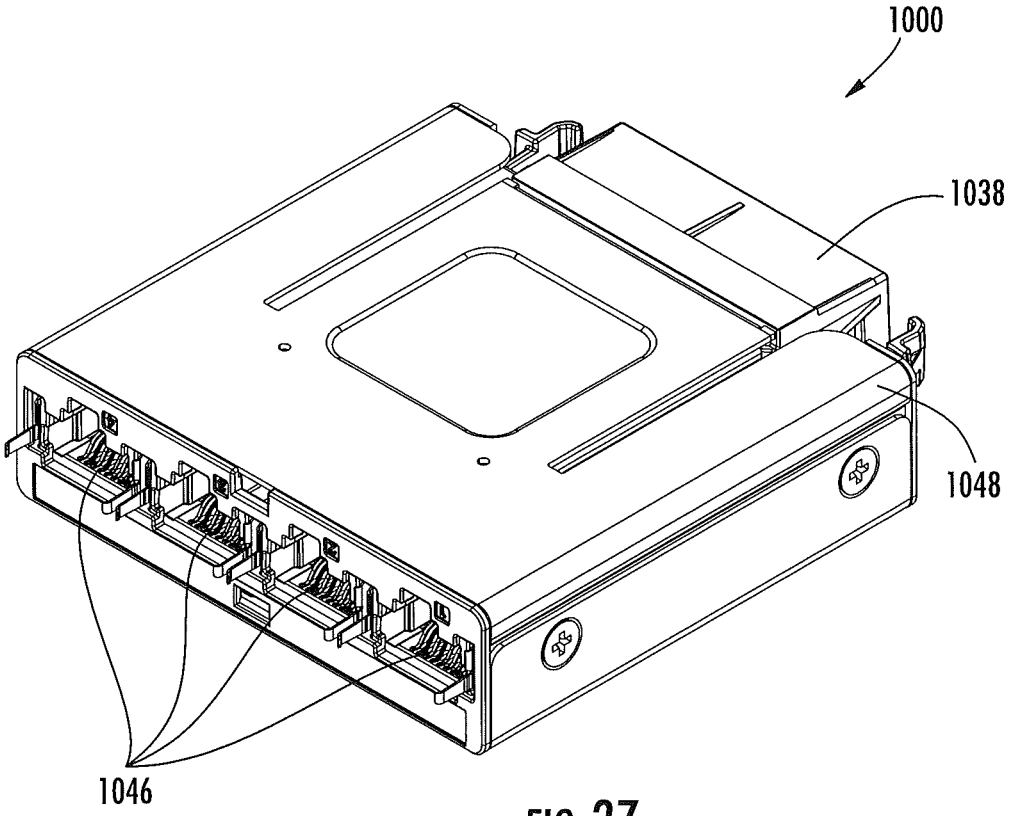
FIG. 37 is a perspective view of a communication module according to alternative embodiments of the present invention.
Figure 38:
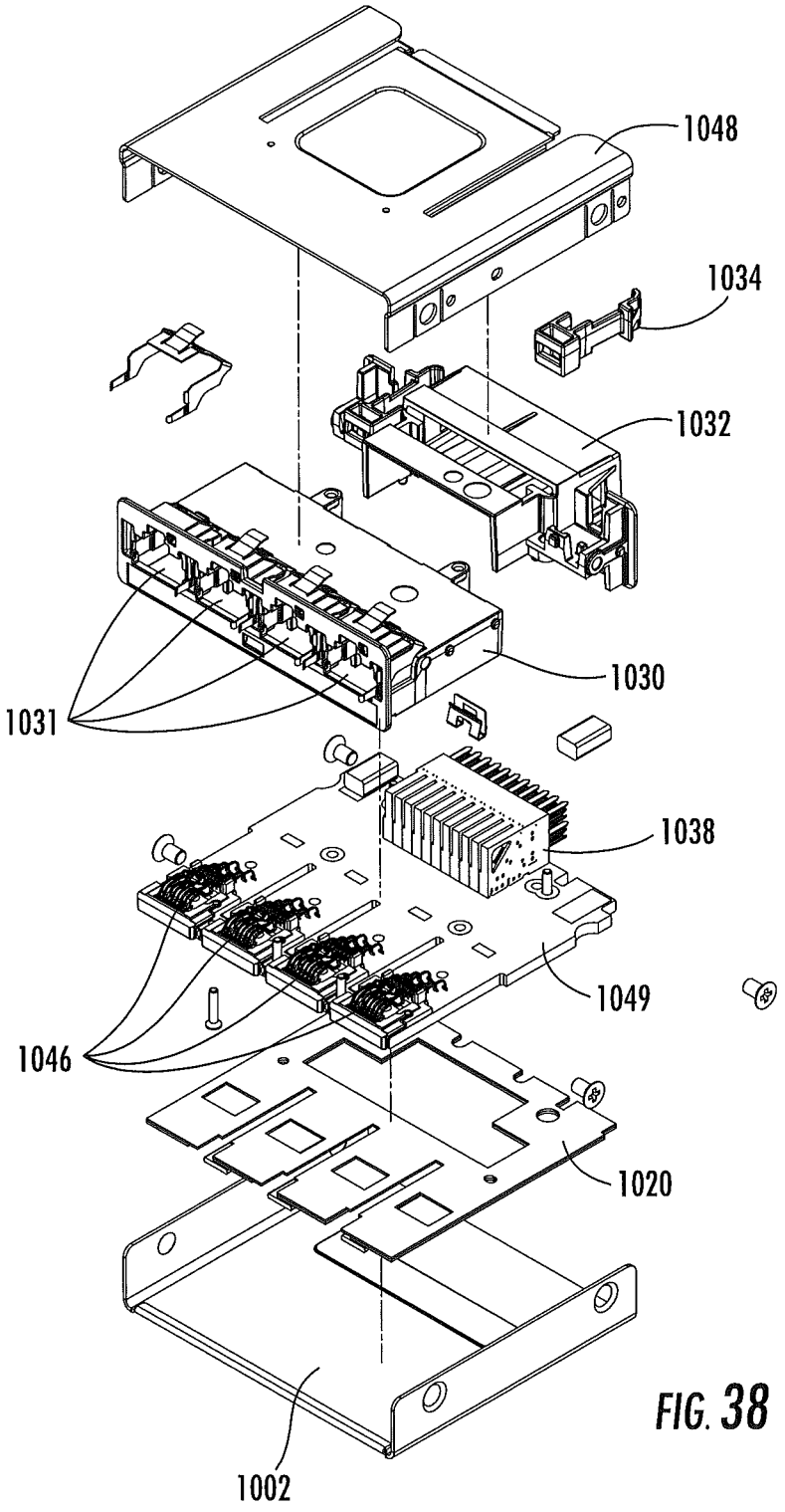
FIG. 38 is an exploded perspective view of the communication module of FIG. 37.

Referring now to FIGS. 37-45, a communications module 1000 and a cable-connector assembly 1100 that embody some of the concepts discussed above are shown therein. Referring first to FIGS. 37 and 38, the module 1000 includes a floor 1002 that mates with a housing 1048. A PCB spacer 1020 is positioned above the floor 1002. A PCB 1049 is positioned above the spacer 1020. Four RJ-45 lead frames 1046 are mounted to the PCB 1049 adjacent one edge thereof. A backplane connector 1038 is mounted to the opposite edge of the PCB 1049; the backplane connector 1038 is electrically connected to the contacts of the RJ-45 lead frames 1046 via traces on the PCB 1049. In this embodiment, the backplane connector 1038 is a "2×11" connector, which indicates that pairs of contacts (each comprising a "channel") are arranged in two rows of eleven contact pairs each. Two shielding housings 1030, 1032 (typically formed of metal) are mounted above the PCB 1049. The shielding housing 1030 includes openings 1031 that align with the lead frames 1046 and form therewith RJ-45 jacks. The housing 1048 is positioned above the shielding housings 1030, 1032. The module 1000 also includes two latches 1034 (only one of which is shown herein) mounted beside the connector 1038 and extending from the housing 1048 to facilitate securing of the module 1000 to the cable-connector assembly 1110.

Like the modules 110, 110' described above, the module 1000 can be mounted within a patch panel such as the patch panel 152. Also, those skilled in this art will recognize that some embodiments may include more or fewer RJ-45 jacks 146 (e.g., six jacks, as shown in FIG. 4), and that the jacks may be formed as separate, discrete units rather than via a common housing like shielding housing 1130.

Referring now to FIGS. 39-43, the cable-connector assembly 1100 includes a cable 1122 that comprises four interconnected cable subunits 1124 arranged in side-by-side relationship. Each of the subunits 1124 includes four twisted pairs of conductors 1126, although other numbers of cables (e.g., six) may also be employed. The cable 1122 also includes three ground wires (not shown).

The conductors 1126 are routed through a wire manager 1400 that separates the pairs from each other, then the individual conductors 1126 from each other, for presentation of the conductors for interconnection with a PCB 1110. The wire manager 1400 is similar in configuration to that shown in FIGS. 15 and 16 above. In this embodiment, the wire manager 1400 is configured to manage sixteen twisted pairs of conductors 1126 and three grounding wires.

Figures 39, 40, 41:
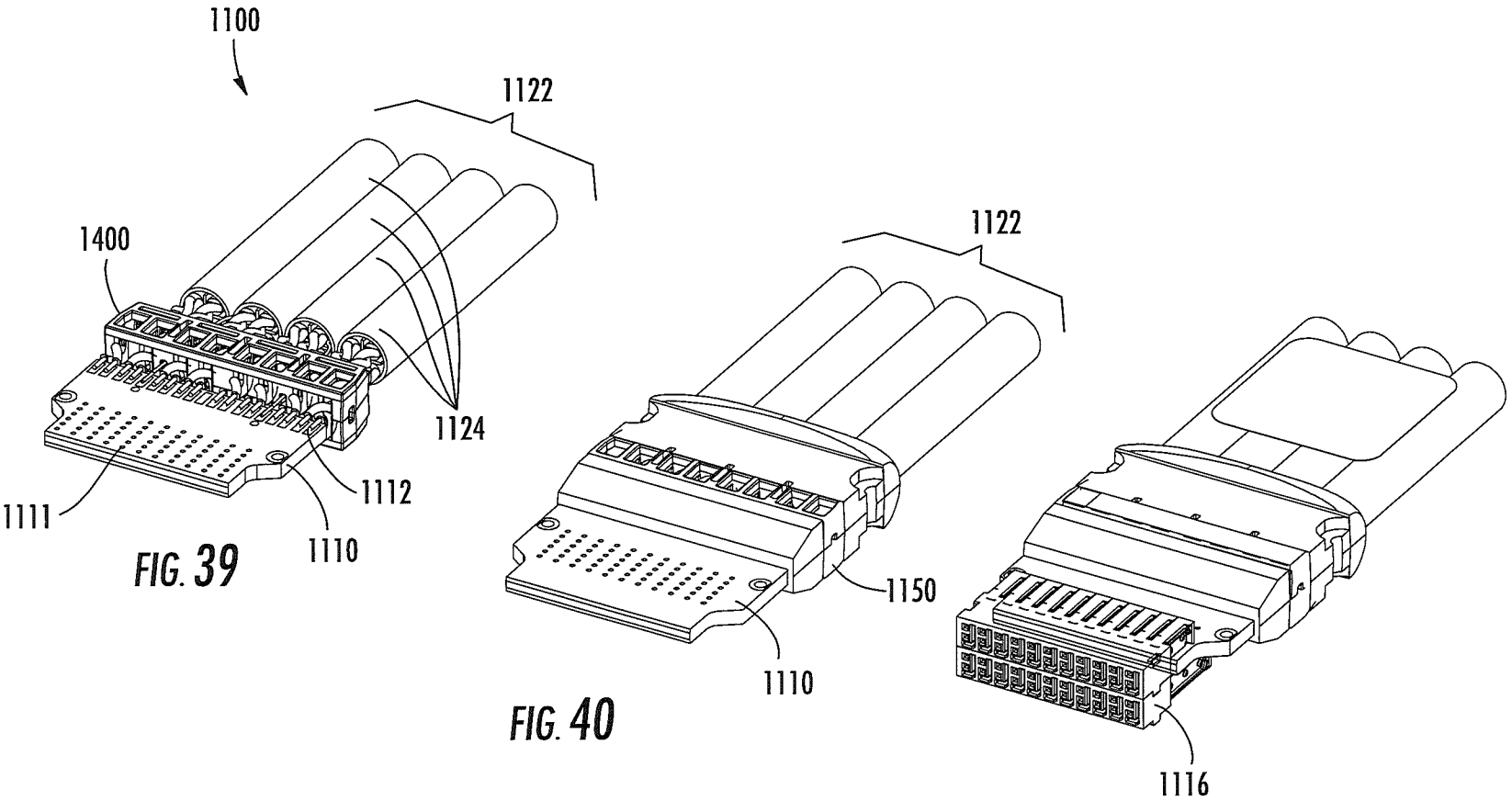
FIGS. 39-41 are perspective views of assembly steps for a cable-connector assembly according to alternative embodiments of the present invention, the cable-connector assembly being matable to the module of FIG. 37.

As is best seen in FIG. 39, the conductors 1126 are attached to the PCB 1110 via soldering, with the conductors 1126 contacting solder pads 1112 positioned on each side of the PCB 1110. In this embodiment, the conductors 1126 of each subunit 1124 are split, with the conductors 1126 of two pairs of each subunit 1124 being mounted to the top of the PCB 1110, and the conductors 1126 of the other two pairs of the subunit 1124 being mounted on the bottom of the PCB 1110. In other embodiments, other arrangements may also be employed. The PCB 1110 includes holes 1111 that are connected with the solder pads 1112 via electrical traces.

As shown in FIG. 40, an overmolded housing 1150 (typically formed of a polymeric material) is mounted to the PCB 1110 over the solder pads 1112 and the ends of the subunits 1124. The overmolded housing 1150 can protect the connections between the conductors 1126 and the solder pads 1112 as well as the open ends of the subunits 1124.

Referring now to FIG. 41, a 2×11 connector 1116 is mounted onto the PCB 1110. The connector 1116 includes eye-of-the-needle contacts (not shown) that are inserted into the holes 1111 of the PCB 1110 and provides receptacles for the contacts of the connector 1038 of the module 1000. The connector 1116 is divided into two mating halves that interconnect, with the result that they both overlie and underlie the edge of the PCB 1110 opposite the cable 1122.

Figure 42:
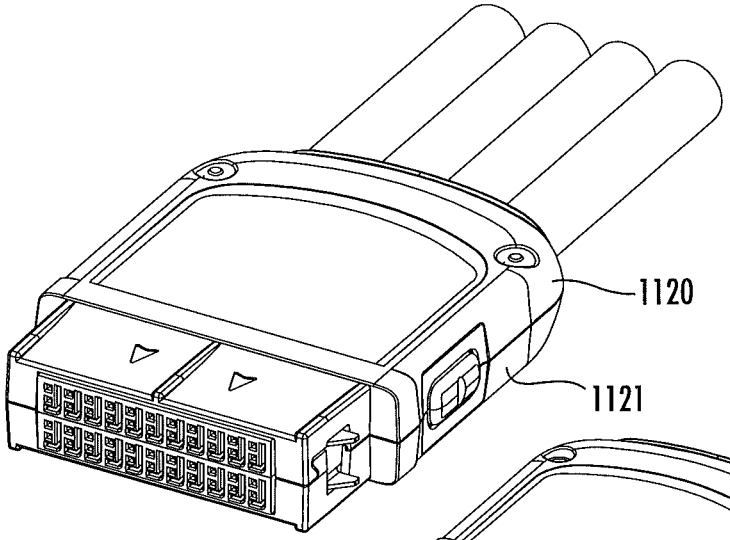
FIG. 42 is a perspective view of the assembled cable-connector assembly of FIGS. 39-41.
Figure 43:
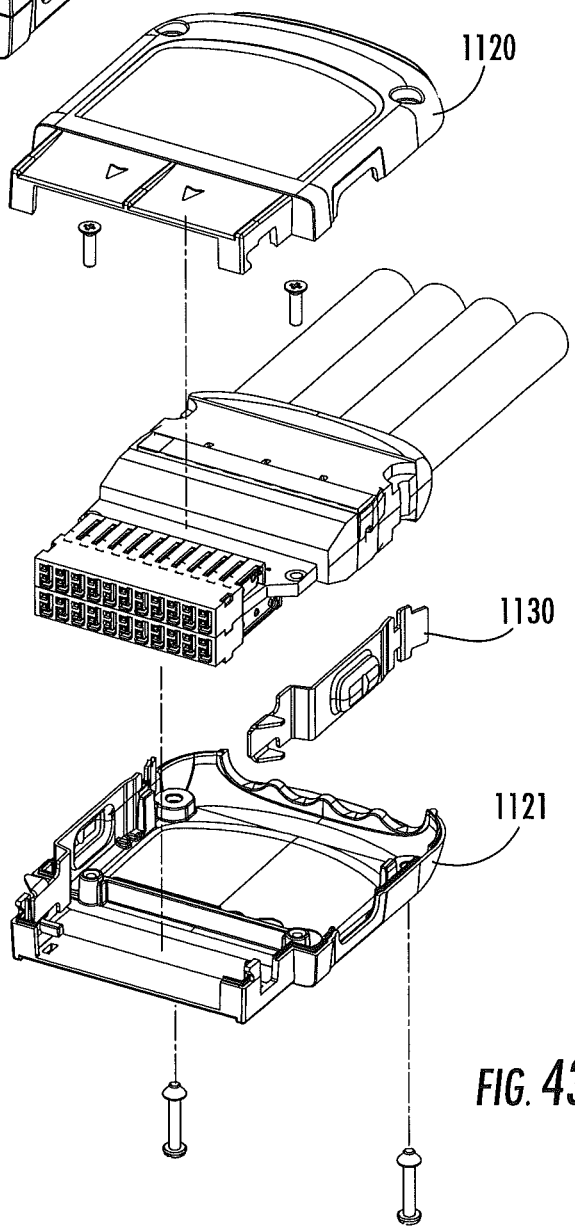
FIG. 43 is an exploded perspective view of the cable-connector assembly of FIG. 42.

Referring now to FIGS. 42 and 43, the cable-connector assembly 1100 also includes a two-piece clamshell-type housing comprising halves 1120, 1121 that sandwich the ends of the cable subunits 1124, the wire manager 1400, the housing 1150, the PCB 1110, and the connector 1116. Latches 1130 (only one of which is shown in FIGS. 42 and 43) are attached within the housing halves 1120, 1121 for interconnection with the module 1000.

Figure 44:
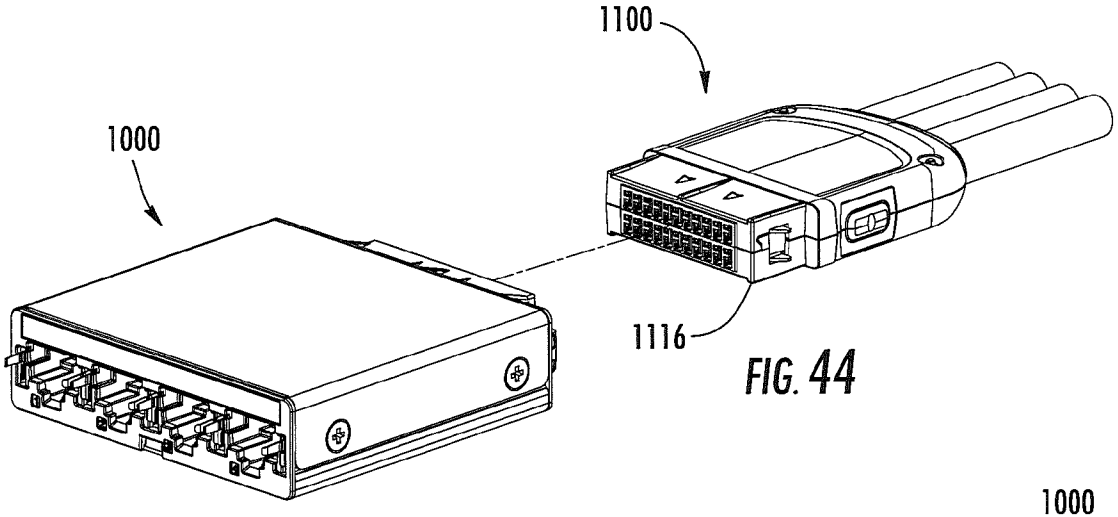
FIG. 44 is a front perspective view of the module of FIG. 37 and the cable-connector assembly of FIG. 42.
Figure 45:
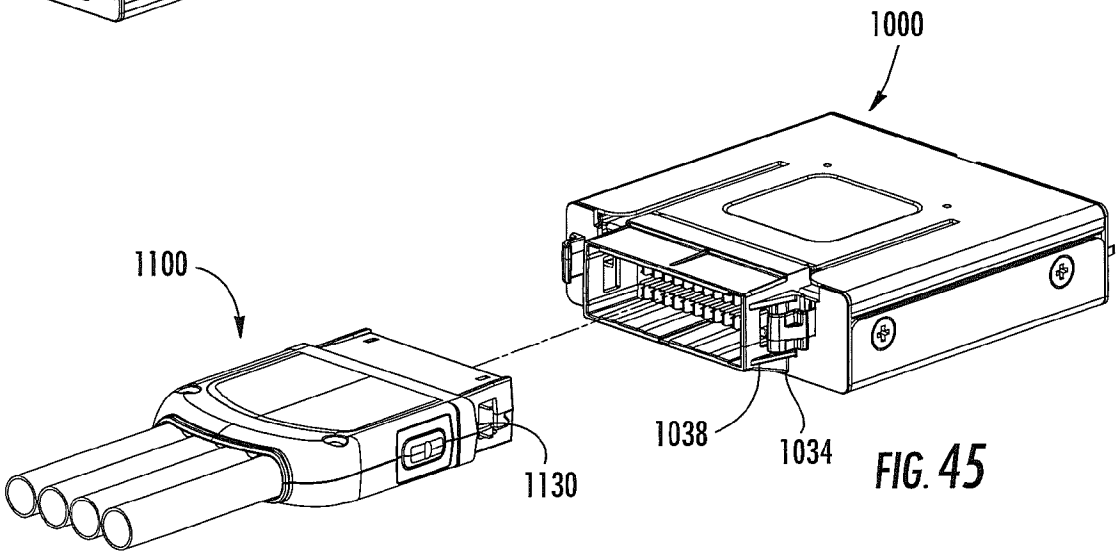
FIG. 45 is a rear perspective view of the module of FIG. 37 and the cable-connector assembly of FIG. 42.

Referring now to FIGS. 44 and 45, it can be seen that the connector 1116 of the cable-connector assembly 1110 can be attached to the backplane connector 1038 of the module 1000 for use thereof, with the contacts of the connector 1038 being inserted into the receptacles of the connector 1116. This action interconnects the conductors 1126 of the cable 1122 with the RJ-45 jacks 1046 of the module 1000. The latches 1130 of the cable-connector assembly 1100 interact with the latches 1034 of the module 1000 to secure the connection between the module 1000 and the cable-connector assembly 1100.

The combination of the module 1000 and the cable-connector assembly 1100 can provide a preterminated cable carrying four separate cable subunits that can be connected quickly and easily into four RJ-45 connectors. Also, the cable-connector assembly 1110 is sized and configured such that it can fit within a standard PCIe slot or a standard CFP slot.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A combination, comprising:

a communications module comprising:

a housing;

a first printed wiring board mounted within the housing;

a plurality of RJ-45 jacks mounted on the first printed wiring board and accessible from one side of the housing; and a single module connector mounted to the first printed wiring board and electrically connected to the RJ-45 jacks, the single module connector being accessible from a second side of the housing; and a cable-connector assembly, comprising:

a cable comprising a plurality of subunits, each of the subunits comprising a jacket and a plurality of twisted pairs of conductors positioned within the jacket; and a single cable connector mounted to a second printed circuit board and electrically connected to the conductors of the cable subunits;

wherein the single module connector is attached to the single cable connector.

2. The combination defined in claim 1, wherein the second printed circuit board to which the conductors of the cable subunits and the single cable connector are mounted establishes the electrical connection between the conductors of the cable subunits and the single cable connector.

3. The combination defined in claim 2, wherein the cable subunits are arranged in a side-by-side relationship.

4. The combination defined in claim 2, wherein the plurality of cable subunits comprises at least four cable subunits, and wherein each cable subunit comprises at least four twisted pairs of conductors.

5. The cable-connector assembly defined in claim 1, wherein the second printed circuit board has first and second opposed surfaces, and wherein some of the conductors of the cable subunits are attached to the first surface, and others of the conductors of the cable subunits are attached to the second surface.

6. The cable-connector assembly defined in claim 5, wherein some of the conductors of each of the subunits are attached to the first surface and some of the conductors of each of the subunits are attached to the second surface.

* * * * *